US010406536B2

(12) United States Patent
Romanov et al.

(10) Patent No.: US 10,406,536 B2
(45) Date of Patent: Sep. 10, 2019

(54) FAN ORIFICE DISPENSING CLOSURE

(71) Applicant: MWV Slatersville, LLC, Slatersville, RI (US)

(72) Inventors: Sergey Romanov, Cranston, RI (US); Clifford Skillin, Blackstone, MA (US); Patrick Brannon, Warwick, RI (US)

(73) Assignee: Silgan Dispensing Systems Slatersville LLC, North Smithfield, RI (US)

( * ) Notice: Subject to any disclaimer, the term of this patent is extended or adjusted under 35 U.S.C. 154(b) by 193 days.

(21) Appl. No.: 14/466,324

(22) Filed: Aug. 22, 2014

(65) Prior Publication Data

US 2014/0361050 A1 Dec. 11, 2014

Related U.S. Application Data

(63) Continuation of application No. 13/178,385, filed on Jul. 7, 2011, now Pat. No. 8,814,010, which is a (Continued)

(51) Int. Cl.
*B05B 1/04* (2006.01)
*B05B 11/00* (2006.01)
(Continued)

(52) U.S. Cl.
CPC ..... *B05B 1/04* (2013.01); *B05B 1/042* (2013.01); *B05B 1/046* (2013.01);
(Continued)

(58) Field of Classification Search
CPC ..... B05B 1/04; B05B 1/042; B05B 1/046; B05B 11/0029; B05B 11/0032;
(Continued)

(56) References Cited

U.S. PATENT DOCUMENTS 1,739,871 A 12/1929 Smith
2,135,237 A * 11/1938 Lewis ..... B65D 47/2037 138/89.3
(Continued)

FOREIGN PATENT DOCUMENTS

EP 0405472 A1 1/1991
EP 0439109 A2 7/1991
(Continued)

OTHER PUBLICATIONS

In Re: Application 09767769.4-2425 PCT/US2009047857 in the name of Polytop Corporation, extended European search report dated Apr. 12, 2012.

*Primary Examiner* — Christopher S Kim
(74) *Attorney, Agent, or Firm* — Barlow, Josephs & Holmes, Ltd.

(57) ABSTRACT

A dispensing closure for a squeeze-type container produces a fan-type spray in a low pressure environment. The dispensing closure includes a closure body having an upper deck and a skirt depending from the upper deck. The skirt is configured and arranged to attach to a product container, such as a squeeze-type container. A flow conduit extends from an interior of the closure body and through the upper deck to provide a flow path from an interior of the closure to an exterior of the closure. The flow conduit has an entrance orifice and an exit orifice. The flow conduit has an inner wall extending between the entrance orifice and the exit orifice. The flow conduit and the closure body are integrally formed. The flow conduit includes a tip portion with an exit orifice defining a shape to provide a fan-type spray in a low pressure environment.

10 Claims, 36 Drawing Sheets

Related U.S. Application Data continuation-in-part of application No. 12/487,583, filed on Jun. 18, 2009, now Pat. No. 8,469,241.

(60) Provisional application No. 61/073,616, filed on Jun. 18, 2008.

(51) Int. Cl.

| | |
|---|---|
| ***B05B 11/04*** | (2006.01) |
| ***B65D 47/06*** | (2006.01) |
| ***B65D 47/08*** | (2006.01) |
| ***B65D 47/24*** | (2006.01) |

(52) U.S. Cl.

CPC ..... *B05B 11/0029* (2013.01); *B05B 11/0032* (2013.01); *B05B 11/047* (2013.01); *B65D 47/06* (2013.01); *B65D 47/0804* (2013.01); *B65D 47/242* (2013.01); *B65D 2251/1008* (2013.01); *B65D 2251/1016* (2013.01); *B65D 2251/20* (2013.01)

(58) Field of Classification Search

CPC ... B05B 11/047; B65D 47/06; B65D 47/0804; B65D 47/242; B65D 2251/1008; B65D 2251/1016; B65D 2251/20

USPC ..... 239/592, 597, 601; 222/211–213, 490, 222/519–521, 531, 532, 548, 549, 553

See application file for complete search history.

(56) References Cited

U.S. PATENT DOCUMENTS

| | | | | |
|---|---|---|---|---|
| 2,755,137 | A | 7/1956 | Hughf | |
| 2,759,643 | A | 8/1956 | Dahlin | |
| 3,877,598 | A * | 4/1975 | Hazard | B65D 47/148 215/224 |
| 4,022,352 | A | 5/1977 | Pehr | |
| 4,109,869 | A | 8/1978 | Brockelsby et al. | |
| 4,175,704 | A | 11/1979 | Cohen | |
| 4,377,247 | A | 3/1983 | Hazard et al. | |
| 4,420,100 | A | 12/1983 | Mueller | |
| 4,561,570 | A * | 12/1985 | Zulauf | B65D 47/2031 222/153.14 |
| 4,718,607 | A | 1/1988 | Levine | |
| 4,760,956 | A | 8/1988 | Mansfield | |
| 4,971,256 | A | 11/1990 | Malcolm | |
| 5,005,737 | A * | 4/1991 | Rohr | B65D 1/32 137/845 |
| 5,040,950 | A | 8/1991 | Dalquist, III et al. | |
| 5,639,025 | A | 6/1997 | Bush | |
| 5,642,860 | A | 7/1997 | Bush et al. | |
| 5,664,732 | A | 9/1997 | Smolen, Jr. et al. | |
| 5,692,682 | A | 12/1997 | Soule et al. | |
| 5,868,323 | A | 2/1999 | Cantor | |
| 5,878,959 | A | 3/1999 | Smolen, Jr. et al. | |
| 5,890,655 | A | 4/1999 | Collias et al. | |
| 5,899,368 | A * | 5/1999 | Joulia | B65D 47/2037 222/507 |
| 5,927,566 | A | 7/1999 | Mueller | |
| 5,967,377 | A | 10/1999 | Glynn | |
| 6,065,651 | A * | 5/2000 | Tedeschi, Jr. | B65D 41/3409 222/519 |
| 6,152,324 | A * | 11/2000 | Baudin | B29C 45/1676 222/1 |
| 6,176,399 | B1 | 1/2001 | Schantz et al. | |
| 6,234,363 | B1 * | 5/2001 | Stradella | B65D 47/2037 222/148 |
| 6,257,457 | B1 | 7/2001 | Oechsel | |
| 6,659,369 | B1 | 12/2003 | Foster et al. | |
| 6,662,973 | B1 * | 12/2003 | Velliquette | B65D 47/42 222/207 |
| 6,698,605 | B2 | 3/2004 | Clodfelter et al. | |
| 6,877,681 | B2 | 4/2005 | Hartle et al. | |
| 6,991,139 | B2 | 1/2006 | Garcia et al. | |
| 7,124,962 | B1 | 10/2006 | Fryan et al. | |
| 7,594,595 | B2 * | 9/2009 | Gueret | A45D 33/006 222/1 |
| 7,648,051 | B1 * | 1/2010 | Montgomery | B65D 47/242 215/330 |
| 7,735,699 | B2 | 6/2010 | Brannon et al. | |
| 7,854,336 | B2 | 12/2010 | Kerner et al. | |
| 2005/0211271 | A1 | 9/2005 | Brumlik | |
| 2005/0279776 | A1 | 12/2005 | Decottignies et al. | |
| 2006/0273195 | A1 | 12/2006 | Junkel | |
| 2007/0295762 | A1 | 12/2007 | Socier | |
| 2007/0295763 | A1 | 12/2007 | Brunner et al. | |

FOREIGN PATENT DOCUMENTS

| | | | |
|---|---|---|---|
| EP | 0905052 | A1 | 3/1999 |
| EP | 0911616 | A1 | 4/1999 |
| WO | 9702896 | | 1/1997 |
| WO | 2004043820 | A1 | 5/2004 |

* cited by examiner

FAN ORIFICE DISPENSING CLOSURE

CROSS REFERENCE TO RELATED APPLICATIONS

This application is a continuation of U.S. application Ser. No. 13/178,385, filed Jul. 7, 2011 (now U.S. Pat. No. 8,814,010, granted Aug. 26, 2014), which is a continuation-in-part of U.S. application Ser. No. 12/487,583 filed Jun. 18, 2009 (now U.S. Pat. No. 8,469,241, granted Jun. 25, 2013), which is a non-provisional application of, and claims the benefit to, U.S. Provisional Patent Application No. 61/073,616 filed Jun. 18, 2008, the entire contents all of which are incorporated herein by reference.

BACKGROUND OF THE INVENTION

The invention relates to container closures, and more particularly to squeeze-type container dispensing closures. This invention relates to a dispensing closure for dispensing liquid. More specifically, it relates to a dispensing closure defining an orifice in the closure to produce a fan-type discharge or spray in a low-pressure environment.

The prior art discloses numerous patents related to high pressure environments for producing various sprays. U.S. Pat. No. 2,755,137 discloses a liquid spray jet and has for its object the provision of a jet. The spray jet includes a jet member having a parallel slided slot. U.S. Pat. No. 4,175,704 discloses a non-aerosol type spray dispenser. The end of a tubular member mounts a spray nozzle built into a parabolic section which extends outwardly from the end of the actuator. U.S. Pat. No. 4,718,607 generally shows a spray orifice adapted for discharging a mixture of atomized liquid entrained within a gas stream for coating a surface with the liquid. U.S. Pat. No. 4,760,956 shows a spray gun that includes a mixing apparatus and an atomizer including a liquid nozzle.

Also, the prior art discloses the use of additional non-squeeze-type dispensing closures to produce various sprays in a high pressure environment. U.S. Pat. No. 4,971,256 shows a sprinkler having a nozzle head abutting the end wall and defining a vertical slot extending radially therethrough. U.S. Pat. No. 5,642,860 shows a slotted spray nozzle. U.S. Pat. No. 5,890,655 discloses a fan spray nozzle having elastomeric dome-shaped tips with a flow conduit outwardly extending from the upper deck. The '655 patent discloses the spray nozzle being made of an elastomeric material having a flexural modulus from about 1,000 psi to about 25,000 psi.

Based upon the prior art cited above, there remains a need for a dispensing closure having a dispensing orifice which allows for liquid discharges in the form of a fan-type spray in a low pressure environment produced by a squeeze-type container.

BRIEF SUMMARY OF THE INVENTION

The invention preserves the advantages of prior dispensing closures for squeeze-type containers. In addition, it provides new advantages not found in currently available dispensing closures for squeeze-type containers and overcomes many disadvantages of such currently available dispensing closures for squeeze-type containers.

The dispensing closure for a squeeze-type container produces a fan-type spray in a low pressure environment. The dispensing closure includes a closure body having an upper deck and a skirt depending from the upper deck. The skirt is configured and arranged to attach to a squeeze-type product container. A flow conduit extends from an interior of the closure body and through the upper deck to provide a flow path from an interior of the closure to an exterior of the closure. The flow conduit has an entrance orifice and an exit orifice. The flow conduit has an inner wall extending between the entrance orifice and the exit orifice.

The flow conduit is configured to produce a fan-type spray in a low pressure environment. A low pressure environment may be produced by a squeeze-type product container upon a force being applied to the product container by a user. In one embodiment, the fan-type spray is provided at less than 5 psi. Alternatively, the fan-type spray may be produced between 0.5 psi and 3 psi which is typically the result of a squeeze produced by an average person.

The flow conduit includes a tip portion for producing a fan-type spray. The tip portion including a raised non-planar surface having an interior volume to collect liquid before the liquid exits through the exit orifice in a low pressure environment. The tip portion defines a shape of the exit orifice which produces the fan-type spray. For example, the shape of the exit orifice may be rectangular, bowtie, half bowtie, oval, keyhole, dumbbell, curved rectangular, "J", "T", inverted "T", inverted "J", and other non-circular shapes. Also, it should be noted that to produce a continuous fan-type spray with desired dimension, the exit orifice may also define a uniform width, with regard to the rectangular shaped orifice, and the tip portion may have a relatively uniform thickness of material.

In one embodiment, the flow conduit, the closure body, and the tip portion are integrally formed to facilitate the fan-type spray in a low pressure environment. The flow conduit includes a first body portion of the flow conduit extending from the upper deck to the tip portion in a gradually decreasing diameter. The tip portion has a height less than the first body portion of the flow conduit. Note, a peripheral wall extends upwardly from the upper deck to surround the first body portion of the flow conduit to capture excess fluids.

In one embodiment including a closure lid, the dispensing closure includes a multiple sealing mechanisms to prevent liquid from exiting through the exit orifice. In one embodiment, the dispensing closure includes a closure lid, a hinge mechanism for connecting the lid to the body and a latching mechanism for securing the lid to the body. In a first sealing mechanism for a dispensing closure having a closure lid, a sealing wedge is positioned on an interior surface of the lid for sealing engagement through the exit orifice of the flow conduit when the lid is in a closed position to prevent the exit of liquid through the exit orifice.

In a second sealing mechanism for a dispensing closure having a closure lid, a sealing member portion of the flow conduit is positioned at upper portion of the flow conduit for engaging an interior of the closure lid when the lid is in a closed position. The interior of the closure lid includes a seal bead to frictionally engage the sealing member portion to prevent the flow of liquid out of the exit orifice. Alternatively, the sealing member portion includes a seal bead to frictionally engage the interior of the closure lid.

In a third sealing mechanism for a dispensing closure having a closure lid, the closure lid includes a mating surface corresponding to an exterior surface of the tip portion. When the lid is in a closed position, the mating surface seals against the tip portion to prevent the flow of liquid through said exit orifice of the flow conduit.

In another embodiment having an insert member, the dispensing closure includes multiple sealing mechanisms to prevent liquid from exiting through the exit orifice. The dispensing closure includes an insert member positioned within the exit aperture of the product container. The insert member includes an insert base for seating within the exit aperture of the product container. The insert member also includes a sealing tube portion extending upwardly from said insert base to occupy an interior volume of said flow conduit.

In a first sealing mechanism for a dispensing closure having an insert member, the sealing tube portion includes a mating surface corresponding to an interior surface of the tip portion to prevent flow of liquid through the exit orifice when the closure body is rotated into a closed position to contact the sealing tube portion.

In a second sealing mechanism for a dispensing closure having an insert member, a sealing member portion of the sealing tube portion is positioned at upper portion of the insert member. The sealing member portion engages an interior of the flow conduit when the closure is rotated into in a closed position to contact the sealing tube portion. The interior of the flow conduit includes a seal bead to frictionally engage the sealing member portion to prevent the flow of liquid out of the exit orifice. Alternatively, the sealing member portion includes the seal bead to frictionally engage the interior of the flow conduit.

In another embodiment, the dispensing closure may also include two pairs of opposing stopping tabs on the inner surface of the outer wall, which cooperate with a single pair of opposed stopping lugs on the container finish. A first, opposed pair of stopping tabs function as child resistant latches to resist movement of the dispensing closure from the closed position to the open position. In operation, the dispensing closure must be squeezed at opposing locations (identified with thumb pads) on the dispensing closure to deform the dispensing closure and move the CR tabs outwardly to overcome the stop lugs. Once freed from the stop lugs, the dispensing closure can then rotate 90 degrees where the second set of stopping tabs engages with the stop lugs to prevent further rotation. This second set of stopping tabs prevents complete removal of the dispensing closure from the container finish.

In operation, the dispensing closure of the present invention provides a fan-type spray in a low pressure environment. The low pressure environment may be less than 5 psi. In one embodiment, the dispensing closure is attached to a squeeze-type product container. When the squeeze-type product container has a force applied by a user, the liquid within the container moves through the flow conduit, up through the tip portion, and discharges through the shaped exit orifice to produce a fan-type spray at less than 5 psi.

It is therefore an object of the present invention to provide a fan-type spray in a low pressure environment.

It is another object of the present invention to provide a sealing mechanism to prevent the flow of liquid through the exit orifice.

Another object of the present invention is to provide a one-piece or two-piece dispensing closure.

It is also another object of the present invention to provide a latching mechanism for securing the lid to the closure body.

A further object of the present invention is to provide a child-resistant latching mechanism.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENTS

In accordance with the present invention, a dispensing closure for squeeze-type containers is disclosed. This invention relates to a dispensing closure for dispensing liquid. More specifically, it relates to a dispensing closure defining an exit orifice in the closure to produce a fan-type discharge or spray in a low-pressure environment.

Figure 1:
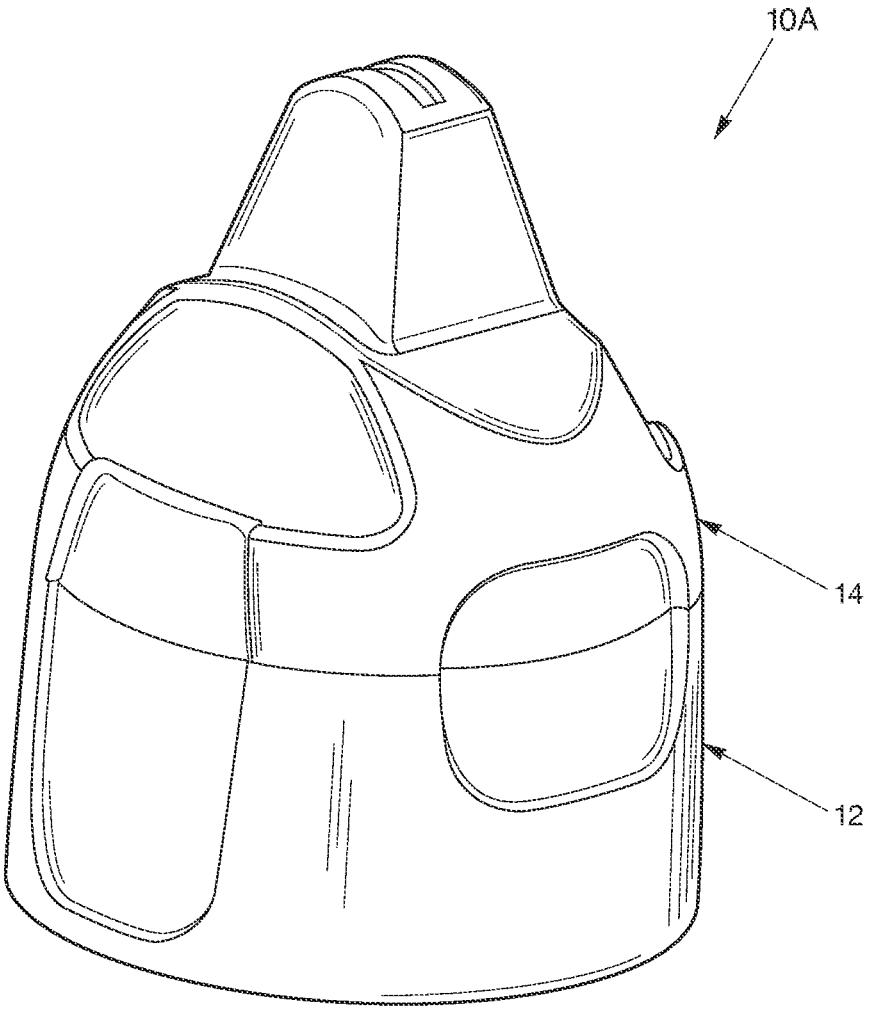
FIG. 1 is a perspective view of a one-piece dispensing closure with a closure lid in an closed position.
Figure 2:
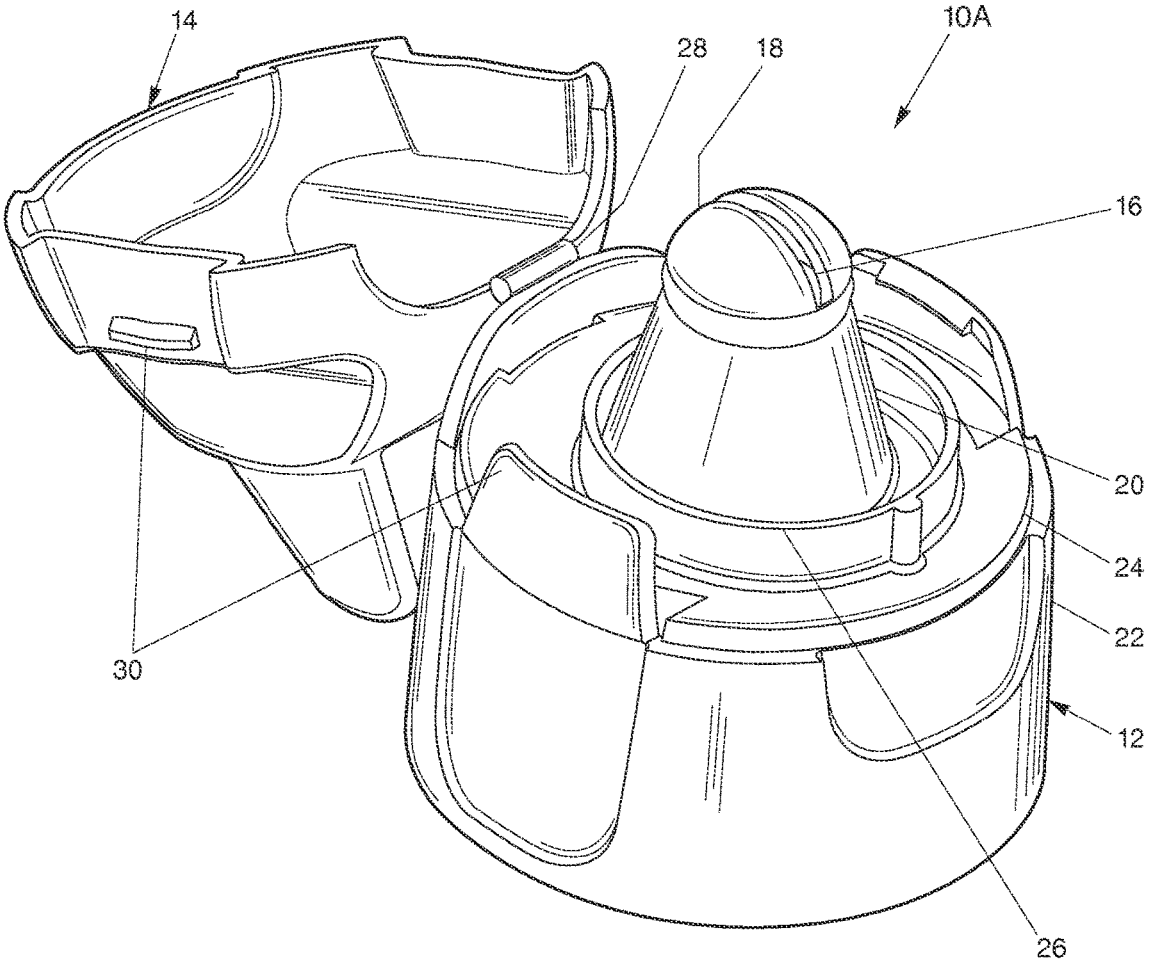
FIG. 2 is a perspective view of the dispensing closure of FIG. 1 in an open position.
Figure 3:
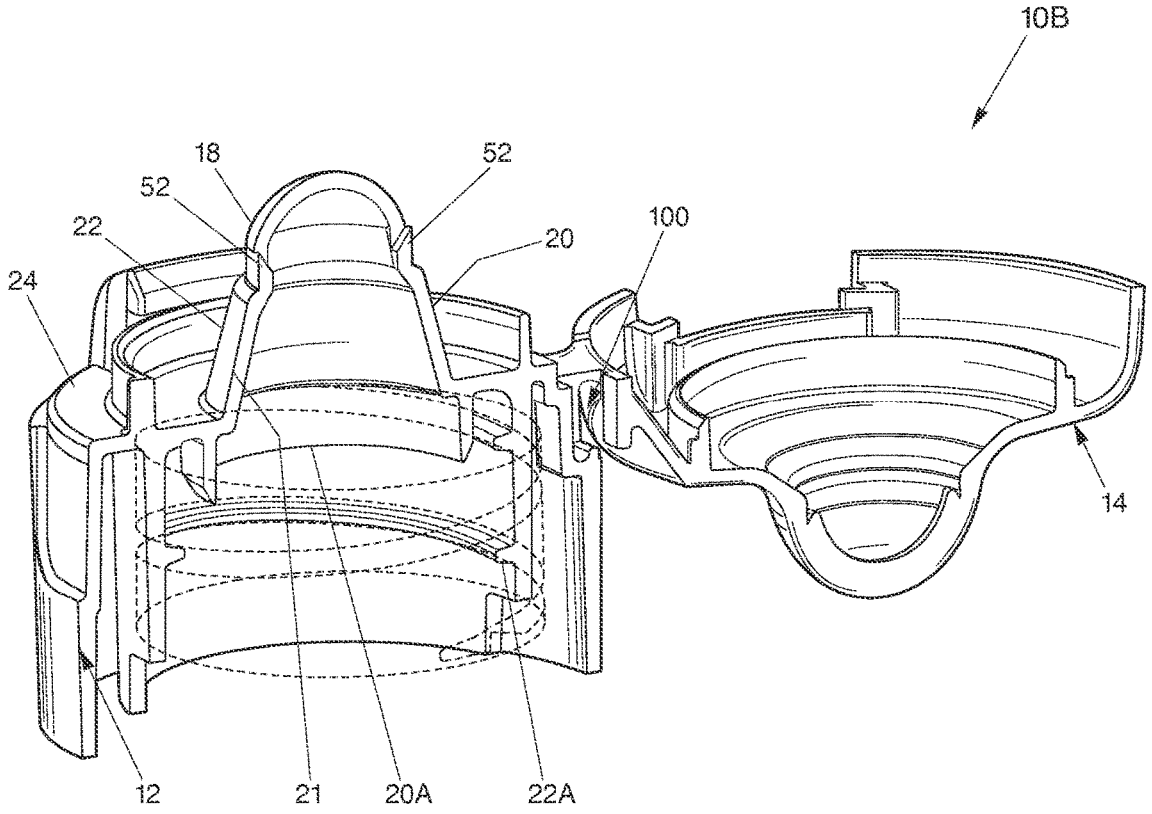
FIG. 3 is a cross-sectional view of a dispensing closure with a closure lid in an open position showing in dotted lines the outline of a neck of a product container.

As shown generally in FIGS. 1-36, the present invention is generally directed to a novel dispensing closure for squeeze-type containers. Most importantly, as shown in FIGS. 1-3, the dispensing closure 10 has an exit orifice 16 defined in a tip portion 18 of the flow conduit 20. The tip portion 18 includes a raised non-planar surface which allows for a collection of liquid before discharging liquid in a fan-type spray through the exit orifice 16 in a low pressure environment. As shown in FIG. 2, it should be noted that a raised spherical surface may be one type of non-planar surface used in the present invention but it is not limited to a raised spherical surface. Also, it should be further noted that the exit orifice 16 may have a shape other than rectangular depending upon the viscosity of the liquid and desired dimension of the fan-type spray.

A low pressure environment may be produced by a squeeze-type product container 900 (FIG. 21) upon a force being applied to the product container 900 by a user. In one embodiment, the fan-type spray is provided at less than 5 psi. Alternatively, the fan-type spray may be produced between 0.5 psi and 3 psi which is typically the result of an average squeeze produced by a person of average strength.

Referring to FIG. 2, the dispensing closure 10 for a squeeze-type container produces a fan-type spray in a low pressure environment. Generally, each of the embodiments includes a closure body 12 having an upper deck 24 and a skirt 22 depending from the upper deck 24 where the skirt 22 is configured and arranged to attach to a product container 900, such as squeeze-type product container 900 or inverted-type container (not shown). Referring to FIG. 3, the skirt 22 includes internal threads 22A for threaded mounting on an open end or neck of a product container (illustrated in dotted lines). However, it is to be understood that other skirt mounting arrangements are also contemplated within the scope of the invention, and the invention should not be limited to the inwardly threaded skirt as the singular means for mounting. Furthermore, the skirt 22 may be a singular or double walled skirt.

A flow conduit 20 extends from an interior of the closure body 12 and through the upper deck 24 to provide a flow path from an interior of the closure 10 to an exterior of the closure 10. The flow conduit 20 has an entrance orifice 20A within the interior of the closure body 12 and an exit orifice 16 outside the exterior of the closure body 12. In one embodiment, the flow conduit 20 is raised in an elongated manner outside the exterior surface of the body closure 12. The flow conduit 20 has an inner wall 21 extending between the entrance orifice 20A and the exit orifice 16. The inner wall 21 is gradually inclined to funnel liquid from an interior of the closure body 12 to the tip portion 18. Note, a peripheral wall 26 extends upwardly from the upper deck 24 to surround a first body portion 22 of the flow conduit 20 to capture excess liquids.

The flow conduit 20 includes the tip portion 18 for facilitating the production of a fan-type spray through the exit orifice 16. The tip portion 18 includes the raised non-planar surface having an interior volume to collect liquid before the liquid exits through the exit orifice 16 under low pressure. The collection of liquid within an interior volume of the raised non-planar surface provides a continuous and even flow of liquid as it exits through the exit orifice 16.

The tip portion 18 defines a shape of the exit orifice 16 which facilitates the production of the fan-type spray. Referring back to FIG. 2, the dispensing orifice 16 is defined along a diameter of a non-planar surface of the flow conduit 20 and the orifice 16 has a substantially rectangular shape. The rectangular exit orifice 16 has a uniform width to provide a uniform thickness and width of the fan-type spray when it exits through the exit orifice 16. Also, it should be noted that to produce a continuous fan-type spray, the exit orifice 16 may also define a uniform width, especially for the rectangular shape, and the tip portion 18 may have a relatively uniform thickness of material.

It should be noted that the rectangular exit orifice 16 and tip portion 18 having the non-planar surface, disclosed in FIGS. 1-3, are an example and that it is contemplated that other dimensions of the width and depth of the tip portion 18 and a radius of the exit orifice 16 may be adjusted to accommodate varying viscosity of the liquid, desired dimensions of the fan-type spray, and intended purpose of the liquid.

The dispensing closure 10 can provide a fan-type discharge using multiple configurations of the dispensing orifice 16. Other shapes of the exit orifice 16 that may be used are, for example, a bowtie shape (FIG. 14), curved rectangular shape (FIG. 15), dumbbell shape (FIG. 16), half bowtie shape (FIG. 17), keyhole shape (FIG. 18), oval shape (FIG. 19), "J" shape, "T" shape, inverted "T" shape, inverted "J" shape, and other non-circular shapes.

The bowtie shape (FIG. 14) of the dispensing or exit orifice 16 provides a lighter stream of liquid from the middle of the dispensing orifice 16 and heavier stream of liquid at its ends. This may be particularly desirable for purposes of discharging a toilet blow cleaner inside an interior of a bowl where more liquid may be desirable in an upper lip area and towards the center of the bowl. In another embodiment, the dispensing orifice may be designed in the shape of a "T", "J", inverted "J", and inverted "T". These different configurations provide a lighter stream of liquid from the middle of the dispensing orifice with a heavier stream at a single end.

In another embodiment, the dispensing orifice 16 may also have a non-uniform width along the tip portion 18 of the flow conduit 20. For example, the "fan" orifice 16 may have an increased or decreased width of the dispensing orifice 16 depending upon the viscosity of the product and desired angular flow of the liquid.

Also, the dispensing orifice 16 may extend less than the entire radius or diameter of the non-planar surface area of the tip portion 18. The dispensing orifice 16 may be set off its normal orientation, by degrees, in order to provide a better or optimal angle for streaming liquid into a toilet bowl or other desirable environment. It should also be noted that the fan-type spray from the present invention may be adjusted by using different shapes, sizes, and/or configurations in accordance with those dispensing characteristics desired.

In one embodiment, the flow conduit 20, the closure body 12, and the tip portion 18 are integrally formed to facilitate the fan-type spray in a low pressure environment. The flow conduit 20 includes a first body portion 22 of the flow conduit 20 extending from the upper deck 24 to the tip portion 18 in a gradually decreasing diameter. The tip portion 18 has a height less than the first body portion 22 of the flow conduit 20 to funnel liquid from an interior of the closure body 12 to the tip portion 18.

Now referring generally to FIGS. 1-3, in a one-piece dispensing closure 10 including a closure lid 14, the dispensing closure 10 includes multiple sealing mechanisms to prevent liquid from exiting through the exit orifice 16. In one embodiment, the dispensing closure 10 includes a closure lid 14, a hinge mechanism 28 for connecting the lid 14 to the body 12, and a latching mechanism 30 for securing the lid 14 to the body 12.

Figure 6:
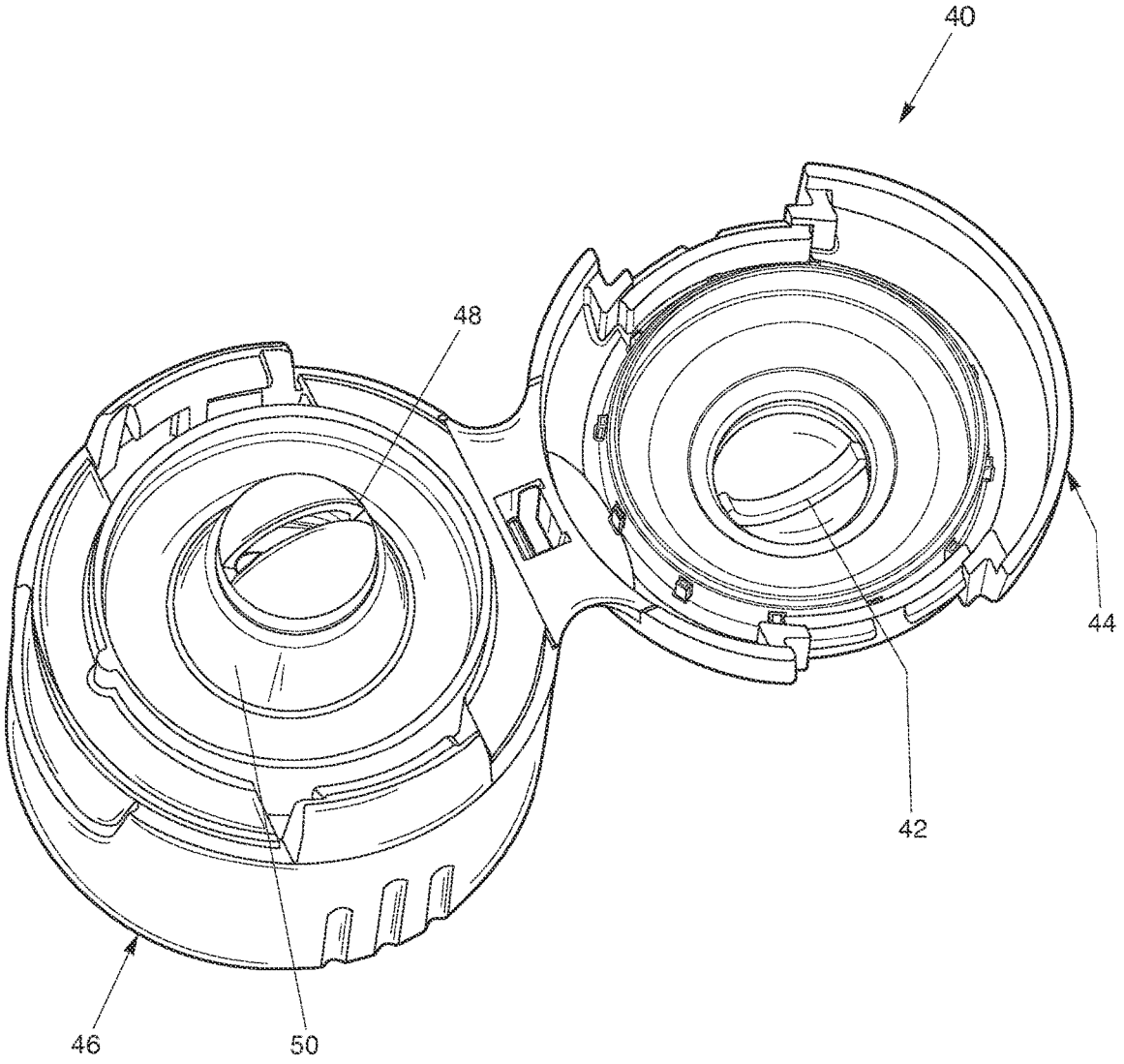
FIG. 6 is a top view of a dispensing closure with a closure lid having a sealing wedge in an open position.
Figure 7:
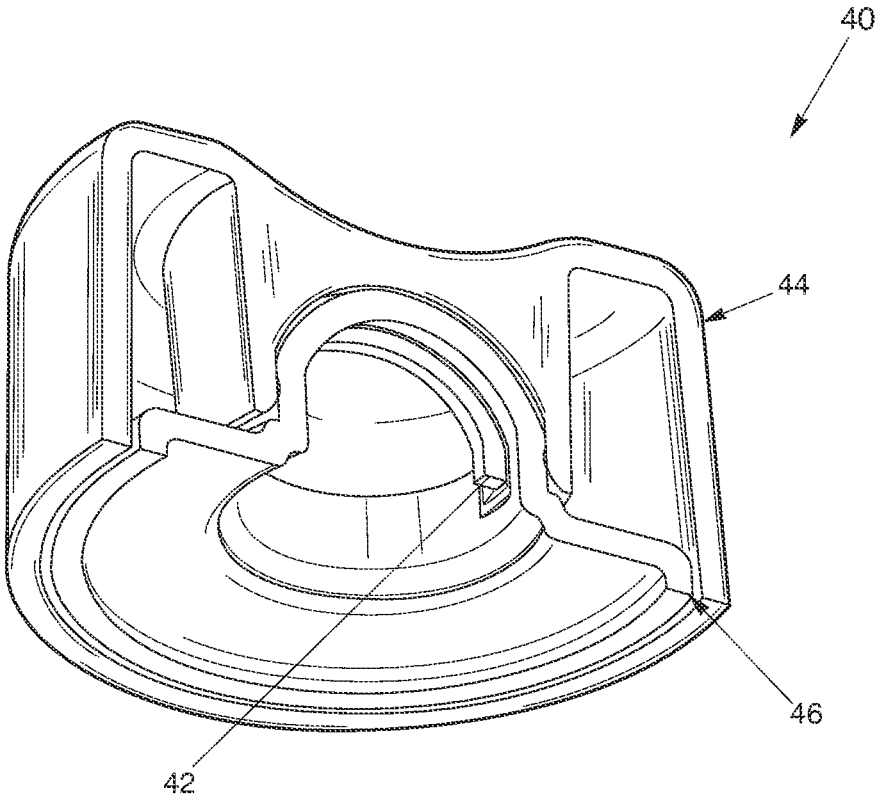
FIG. 7 is an elevated cross-sectional view of a dispensing closure with a closure lid having a sealing wedge in a closed position.
Figure 8:
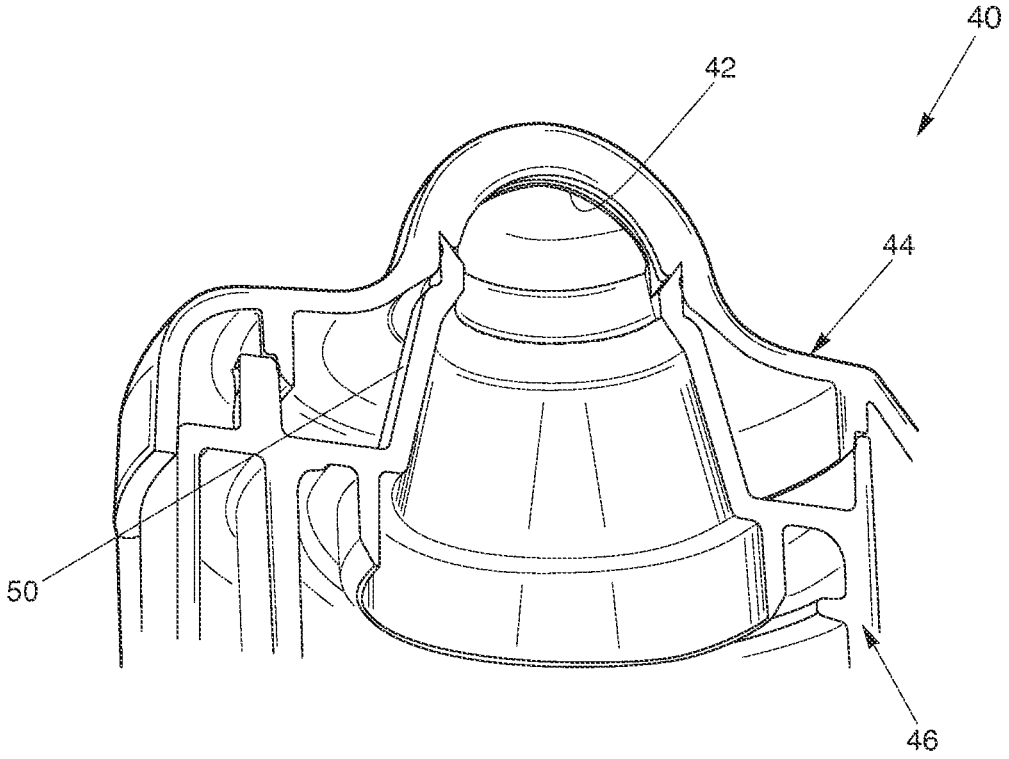
FIG. 8 is a cross-sectional view of the dispensing closure of FIG. 6 having a closure lid having a sealing wedge in a closed position.

Referring to FIGS. 6-8, in a first sealing mechanism for a dispensing closure 40 having a closure lid 44, a sealing wedge 42 is positioned on an interior surface of the lid 44 for sealing engagement through the exit orifice 48 of the flow conduit 50 when the lid 44 is in a closed position to prevent the exit of liquid through the exit orifice 48.

Figure 4:
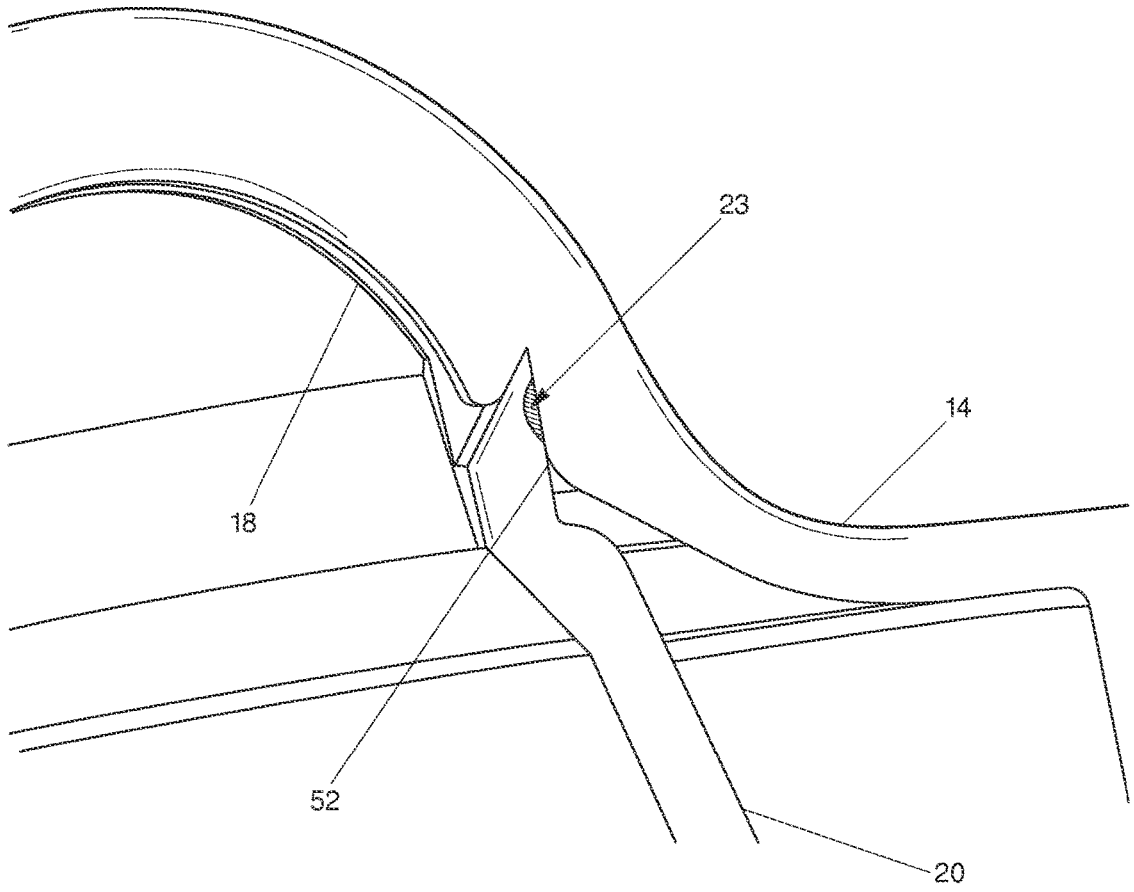
FIG. 4 is an elevated cross-sectional view of the dispensing closure of FIG. 3 with closure lid in a closed position.

Referring to FIGS. 3-4, in a second sealing mechanism for a dispensing closure 10B having a closure lid 14, a sealing member portion 52 of the flow conduit 20 is positioned at an upper portion of the flow conduit 20 for engaging an interior of the closure lid 14 when the lid 14 is in a closed position. The interior of the closure lid 14 includes a seal bead 23 to frictionally engage the sealing member portion 52 to prevent the flow of liquid out of the exit orifice 16. Alternatively, the sealing member portion 52 includes a seal bead to frictionally engage the interior of the closure lid 14.

In a third sealing mechanism for a dispensing closure 10B having a closure lid 14, the closure lid 14 includes a mating surface corresponding to an exterior non-planar surface of the tip portion 18. When the lid 14 is in a closed position, the mating surface seals against the tip portion 18 to prevent the flow of liquid through the exit orifice 16 of the flow conduit 20.

In a fourth sealing mechanism for a dispensing closure 60 having a closure lid 62, the closure lid 62 includes an inner circular wall 66 depending from a central region. Preferably, the inner circular wall 66 has a diameter to allow for a friction fit with the sealing member portion 68 of the flow conduit 70. When the closure lid 62 is in a closed position, the inner circular wall 66 snaps over the exit orifice 72 to prevent the exit of liquid therethrough.

Now referring generally to FIGS. 9-13, in a two-piece dispensing closure 80 having an insert member 84 and a closure body 82, the dispensing closure 80 includes multiple sealing mechanisms to prevent liquid from exiting through the exit orifice 86. The dispensing closure 80 includes an insert member 84 positioned within the open end of the product container 900. The insert member 84 includes an insert base 88 for seating within the open end of the product container 900. The insert member 88 also includes a sealing tube portion 90 extending upwardly from said insert base 88 to occupy an interior volume of the flow conduit 92.

Figure 9:
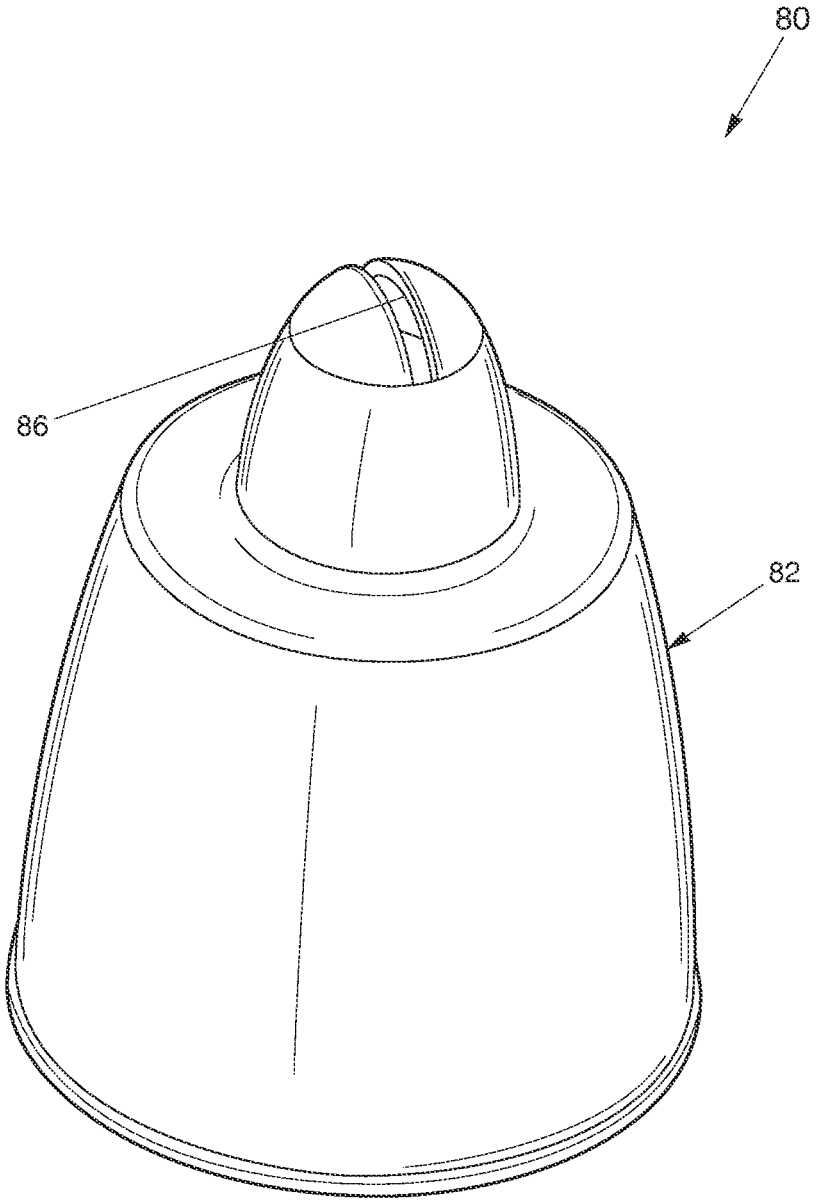
FIG. 9 is a perspective view of a two-piece dispensing closure with an insert member.
Figure 10:
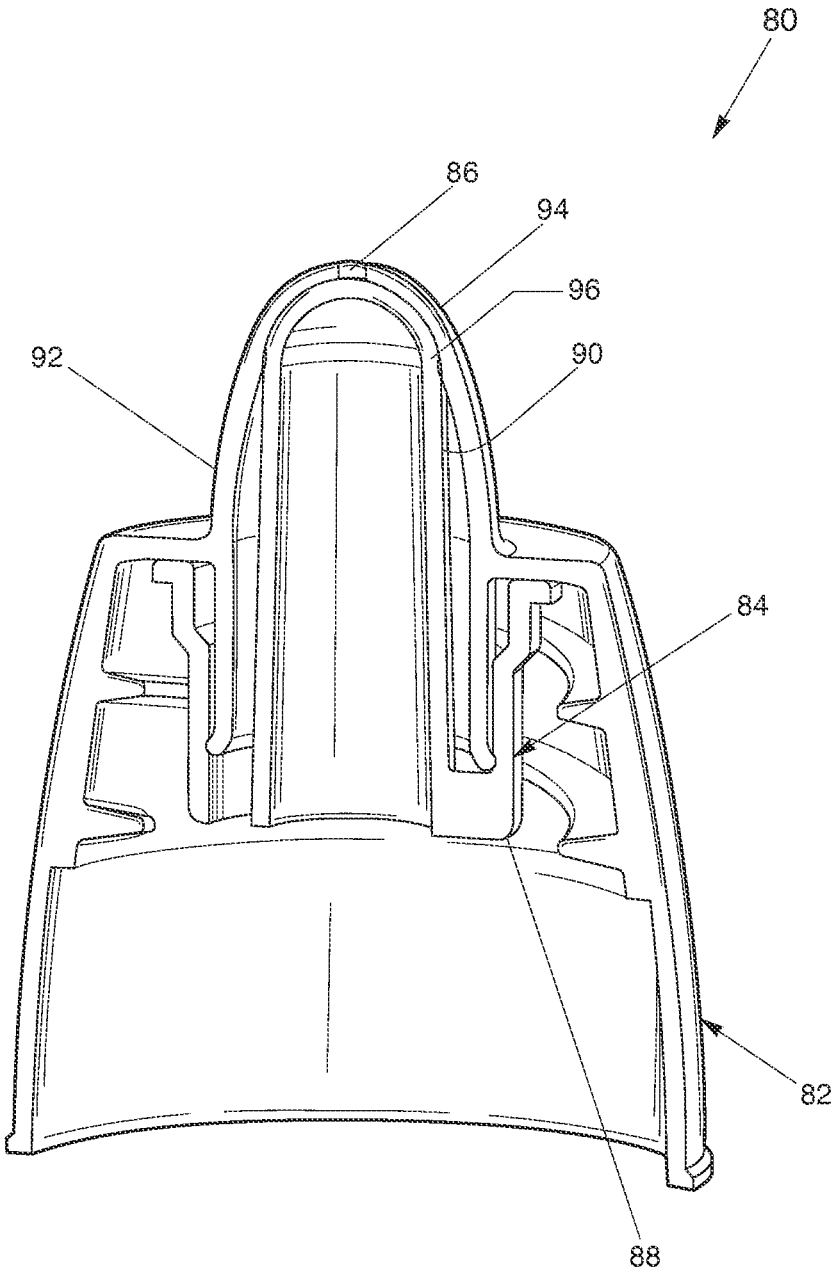
FIG. 10 is a cross-sectional view of the dispensing closure of FIG. 9 in a closed position.

Referring to FIG. 9-10, in a first sealing mechanism for a dispensing closure 80 having an insert member 84, the sealing tube portion 90 includes a mating surface corresponding to an interior surface of the tip portion 94. When the closure body 82 is rotated into a closed position to contact the sealing tube portion 90 with the interior surface of the tip portion 94, the liquid is prevented from discharging through the exit orifice 86.

Figure 11:
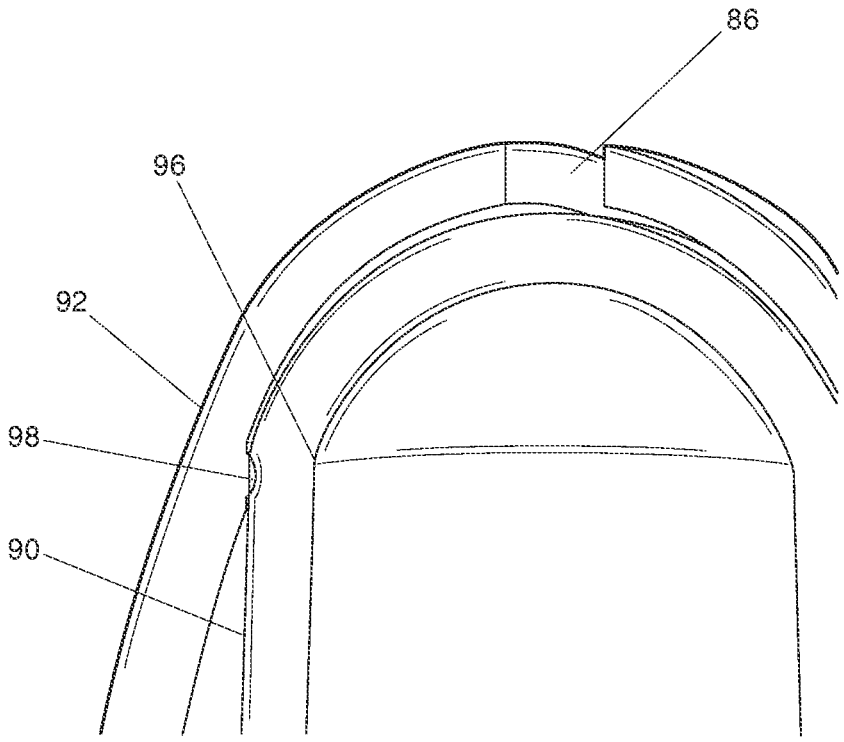
FIG. 11 is an elevated cross-sectional view of the dispensing closure of FIG. 9 in a closed position.
Figure 12:
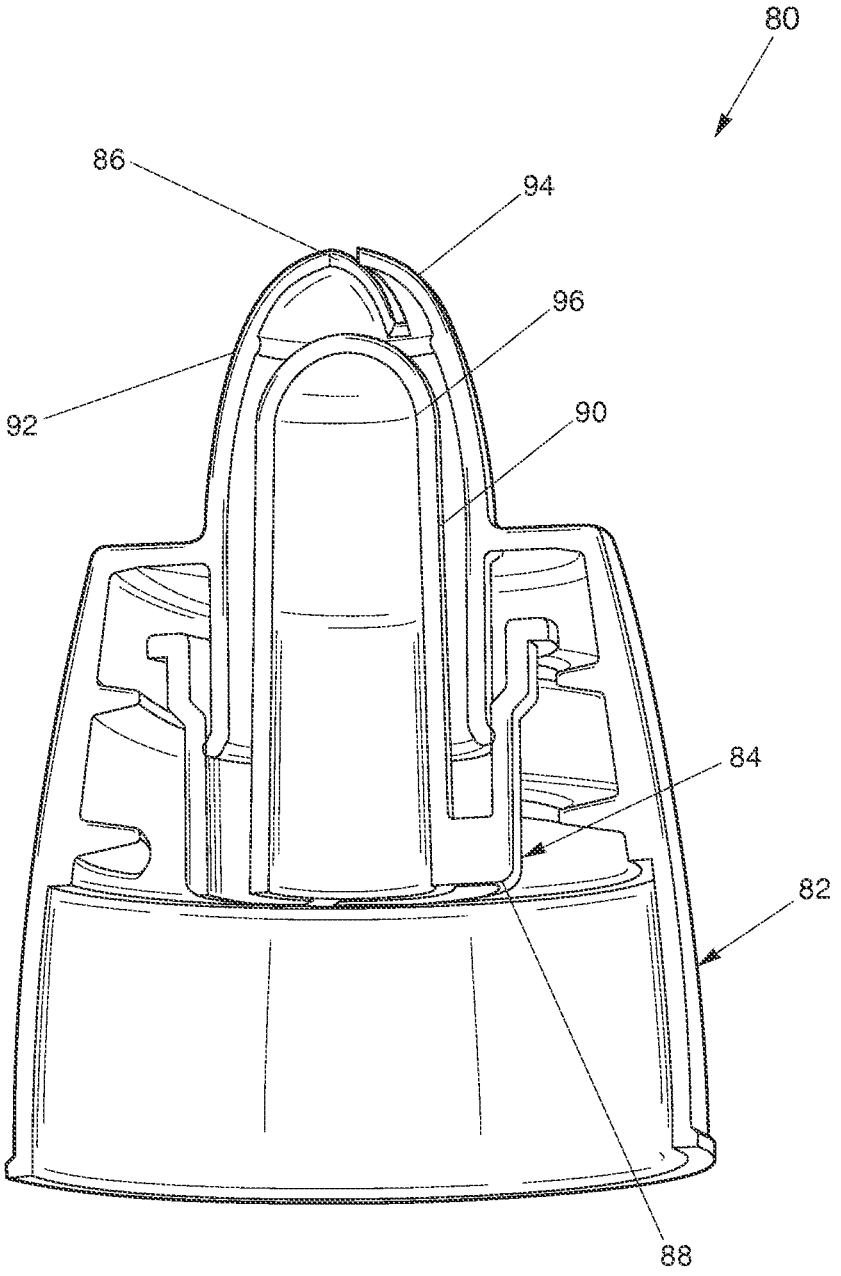
FIG. 12 is a cross-sectional view of the dispensing closure of FIG. 9 in an open position.
Figure 13:
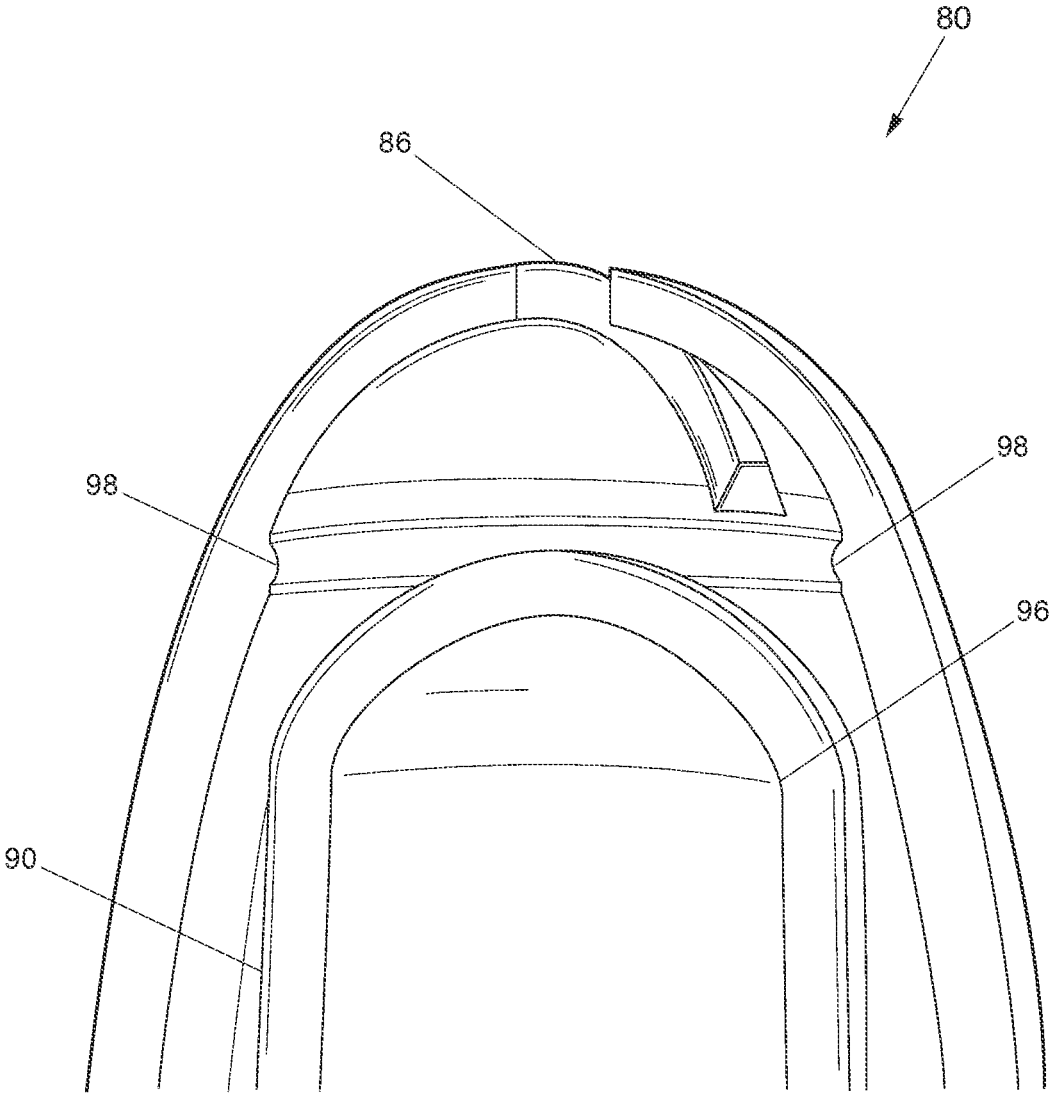
FIG. 13 is an elevated cross-sectional view of the dispensing closure of FIG. 9 in an open position.
Figure 14:
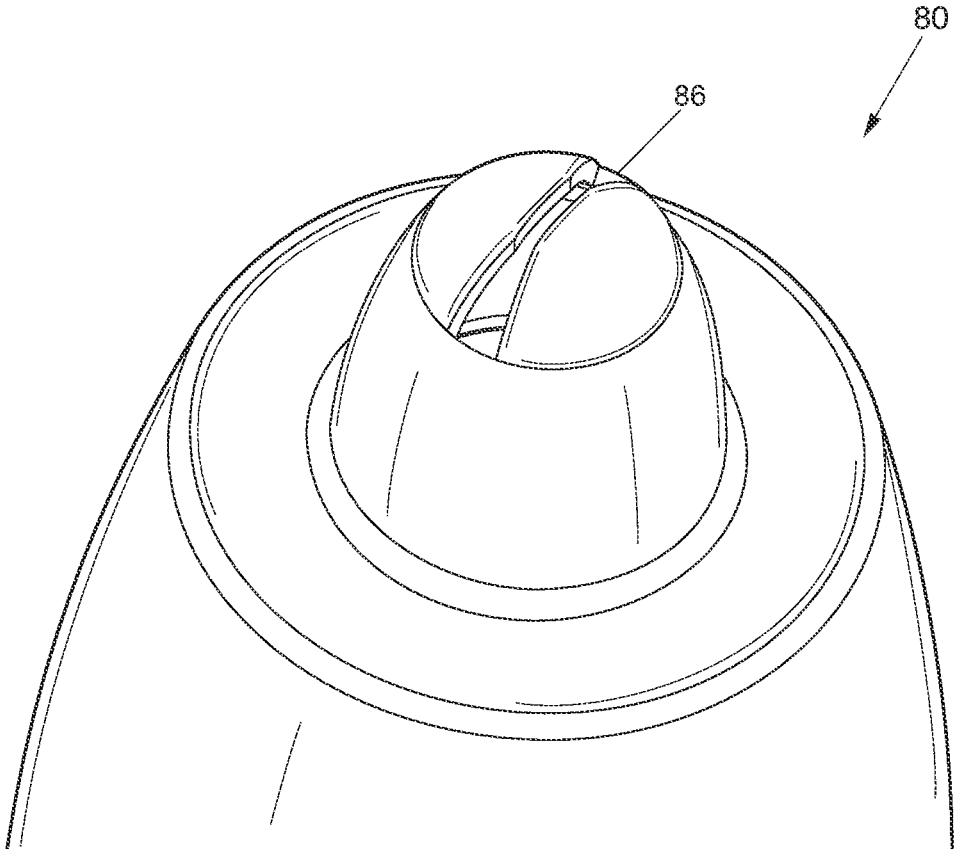
FIG. 14 is a top view of the dispensing closure of FIG. 9 including an exit orifice having a bowtie shape.
Figure 15:
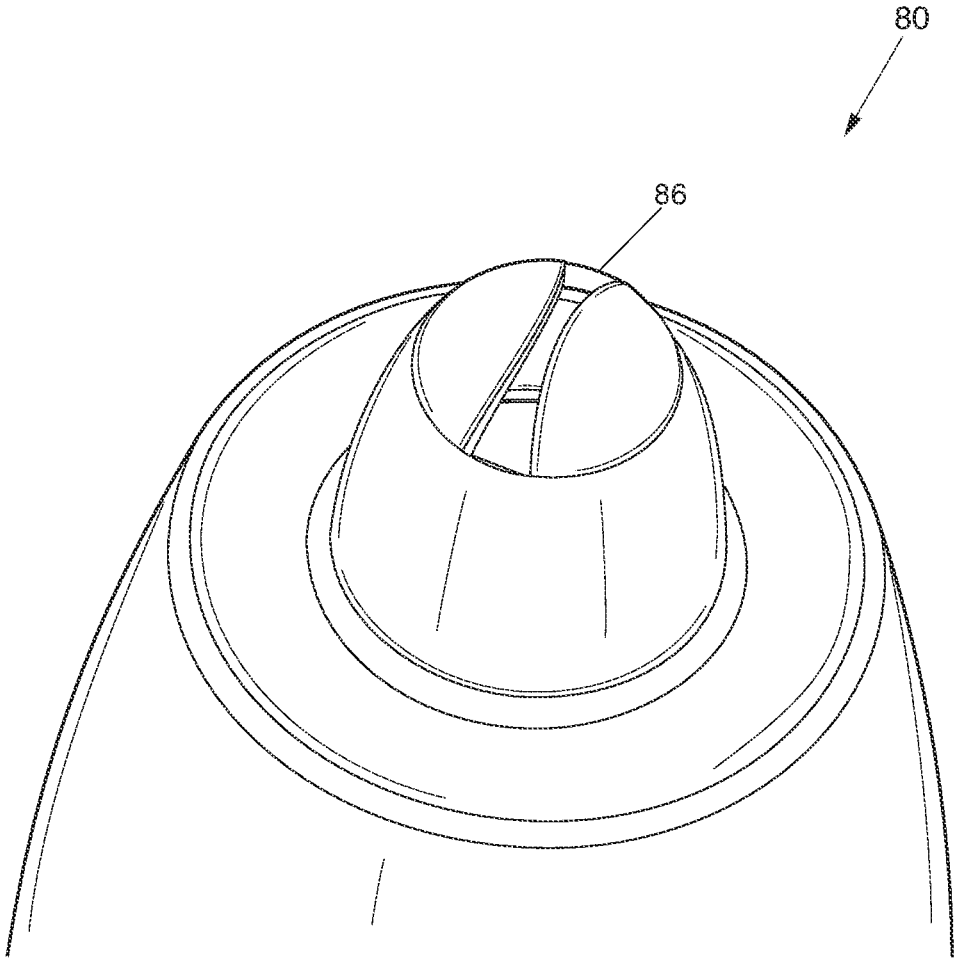
FIG. 15 is a top view of the dispensing closure of FIG. 9 including an exit orifice having a curved rectangular shape.
Figure 16:
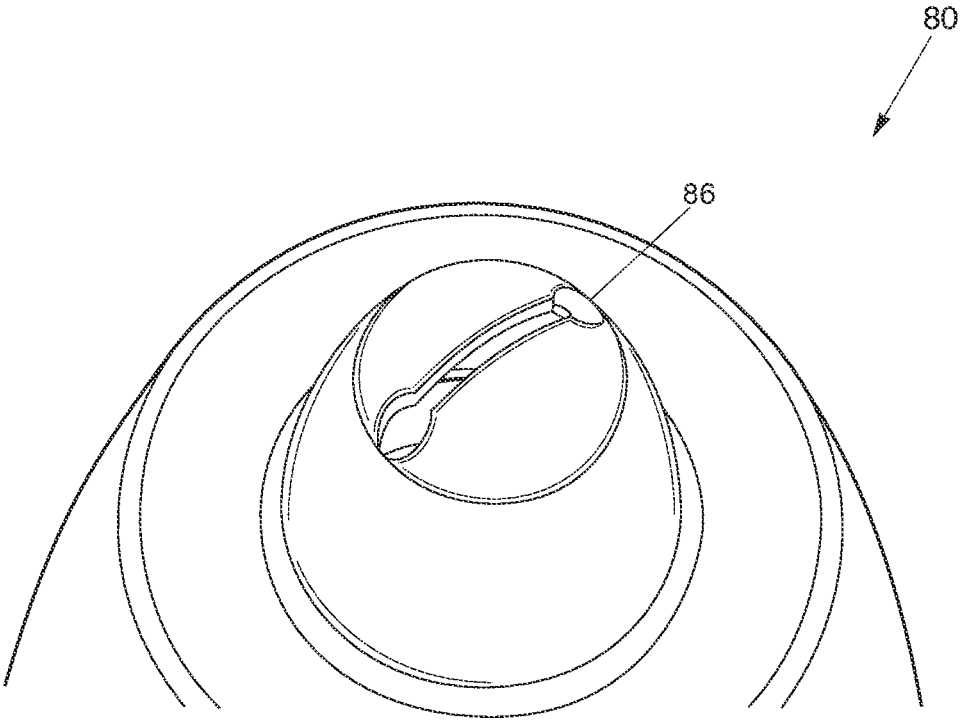
FIG. 16 is a top view of the dispensing closure of FIG. 9 including an exit orifice having a dumbbell shape.
Figure 17:
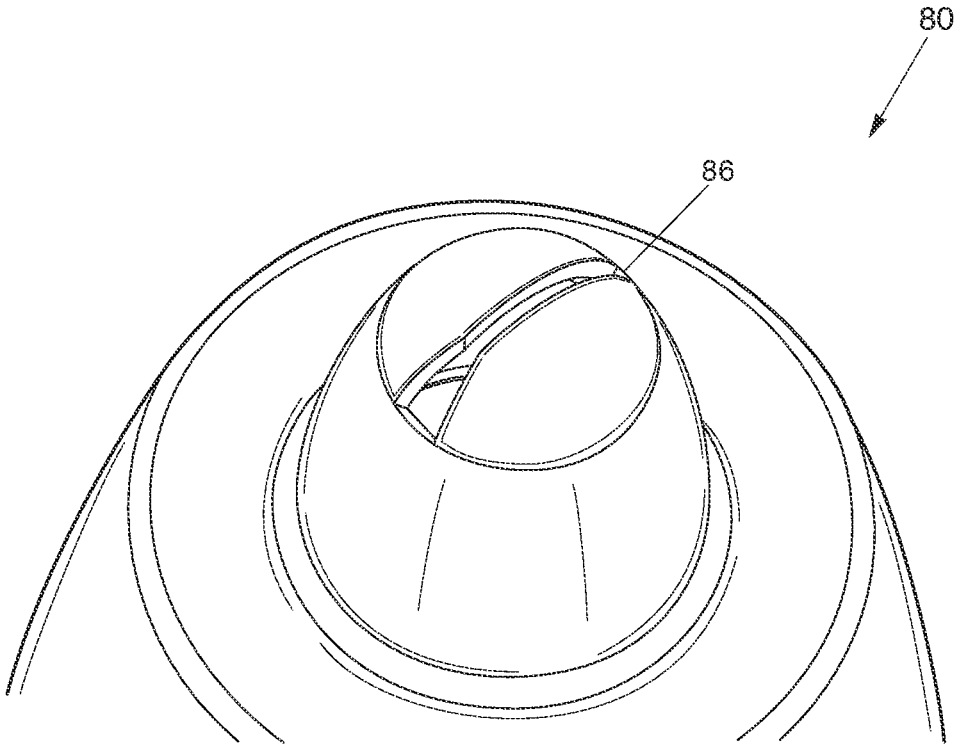
FIG. 17 is a top view of the dispensing closure of FIG. 9 including an exit orifice having a half bowtie shape.
Figure 18:
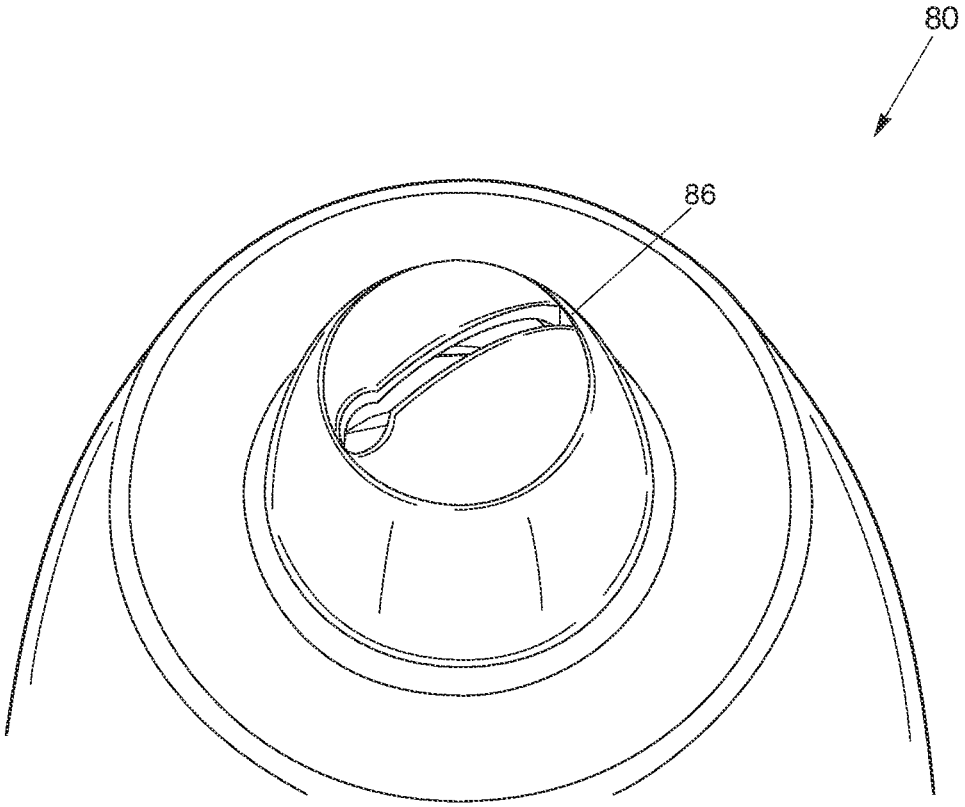
FIG. 18 is a top view of the dispensing closure of FIG. 9 including an exit orifice having a fan keyhole shape.
Figure 19:
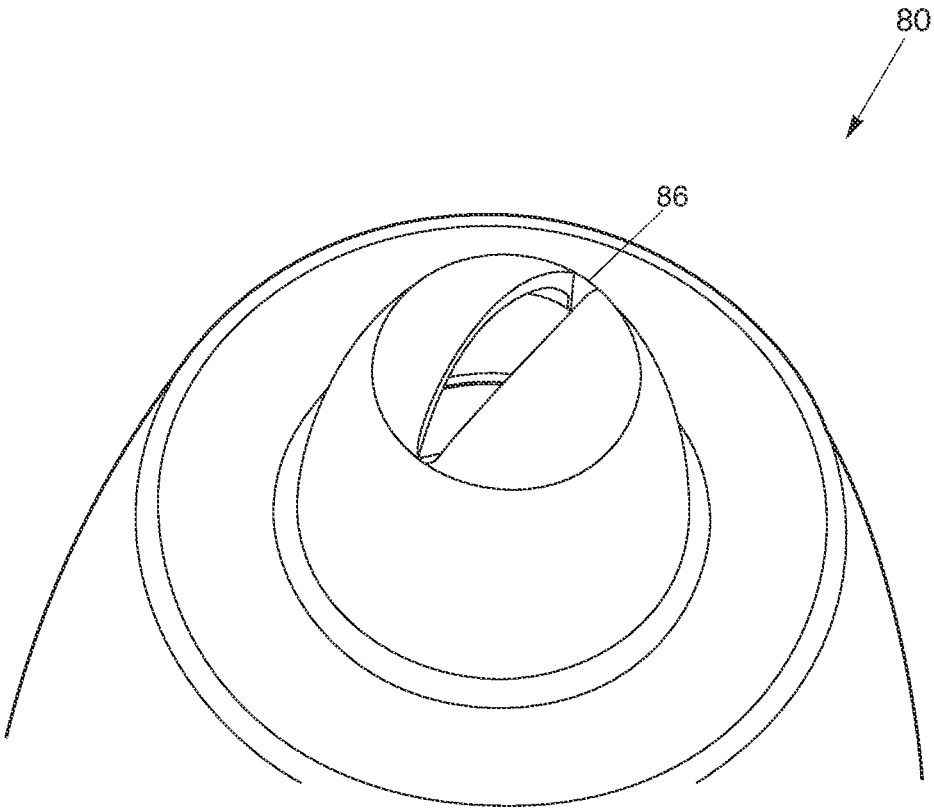
FIG. 19 is a top view of the dispensing closure of FIG. 9 including an exit orifice having an oval shape.

Referring to FIG. 11, in a second sealing mechanism for a dispensing closure 80 having an insert member 84, a sealing member portion 96 of the sealing tube portion 90 is positioned at an upper area of the insert member 84. The sealing member portion 96 engages an interior of the flow conduit 92 when the closure body 82 is rotated into in a closed position to contact the sealing tube portion 90. The interior of the flow conduit 92 includes a seal bead 98 to frictionally engage the sealing member portion 96 to prevent the flow of liquid out of the exit orifice 86. Alternatively, the sealing member portion 96 includes the seal bead to frictionally engage the interior of the flow conduit 92. Referring to FIGS. 12-13, when the dispensing closure is rotated into an open position, the closure body 82 disengages from contact with the insert member 88 to allow the flow of liquid through the exit orifice 86.

Referring to FIGS. 14-19, the dispensing closure 80 can provide a fan-type discharge using multiple configurations of the dispensing orifice 86. Other shapes of the exit orifice 86 that may be used are, for example, a bowtie shape (FIG. 14), curved rectangular shape (FIG. 15), dumbbell shape (FIG. 16), half bowtie shape (FIG. 17), keyhole shape (FIG. 18), oval shape (FIG. 19), "J" shape, "T" shape, inverted "T" shape, inverted "J" shape, and other non-circular shapes As shown generally in FIGS. 1-8, the dispensing closure 10A, 10B, 40, 60 may have a lid which is attached to the dispensing closure by a hinge mechanism, such as a living hinge. Also, referring to FIG. 3, the dispensing closure 10B may include a latching flange 100 near the hinge mechanism. When the lid 14 is pivoted about the hinge, the latching flange 100 extending from the closure lid 14 may engage a portion of the closure body 12 to facilitate an open position of the lid 14.

Figure 5:
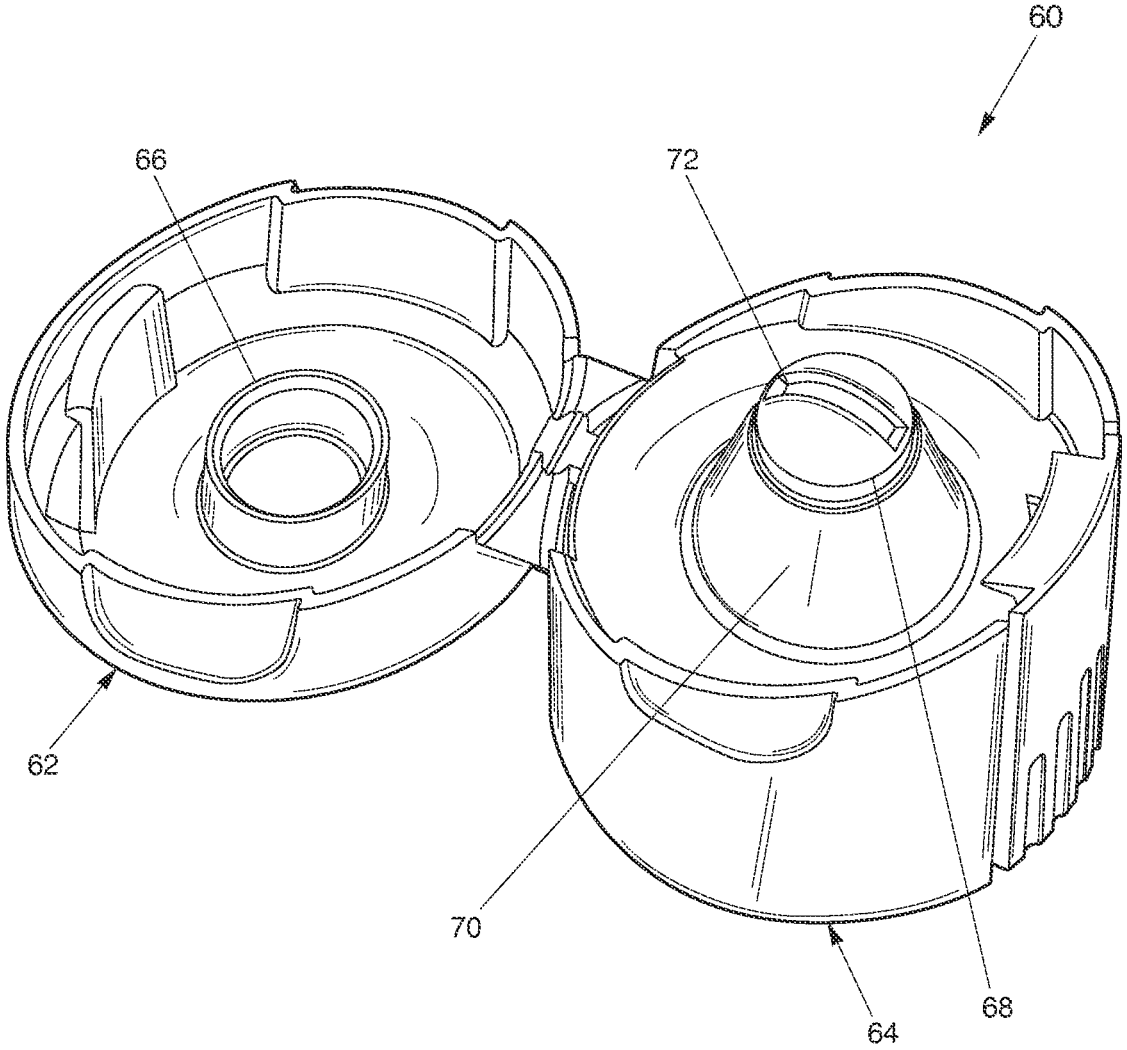
FIG. 5 is a perspective view of a dispensing closure with a closure lid having an interior circular wall for closing the exit orifice.

As shown generally in FIGS. 1-8, the dispensing closure 10A, 10B, 40, 60 may also include various latching mechanisms for releasably securing the closure lid to the closure body. Referring to FIGS. 2 and 6, a dispensing closure is illustrated that includes a child-resistant latching mechanism. This latching mechanism features a double-walled skirt having diametrically opposing sides which are depressed, at a lower portion, before opening the closure lid hingedly connected to the closure. In operation, the dispensing closure disengages the lid from the closure body by pushing inwardly on the outer side wall of the skirt to move hook members on the closure body away from hook members on the closure lid and away from a central axis of the dispensing closure. Also, a single latching mechanism may also be used as shown in FIG. 5. It should be noted that FIGS. 1-8 show an example of one type of hinge mechanism and latching mechanism and that other types of lid configurations may be used in the present invention.

Figure 21:
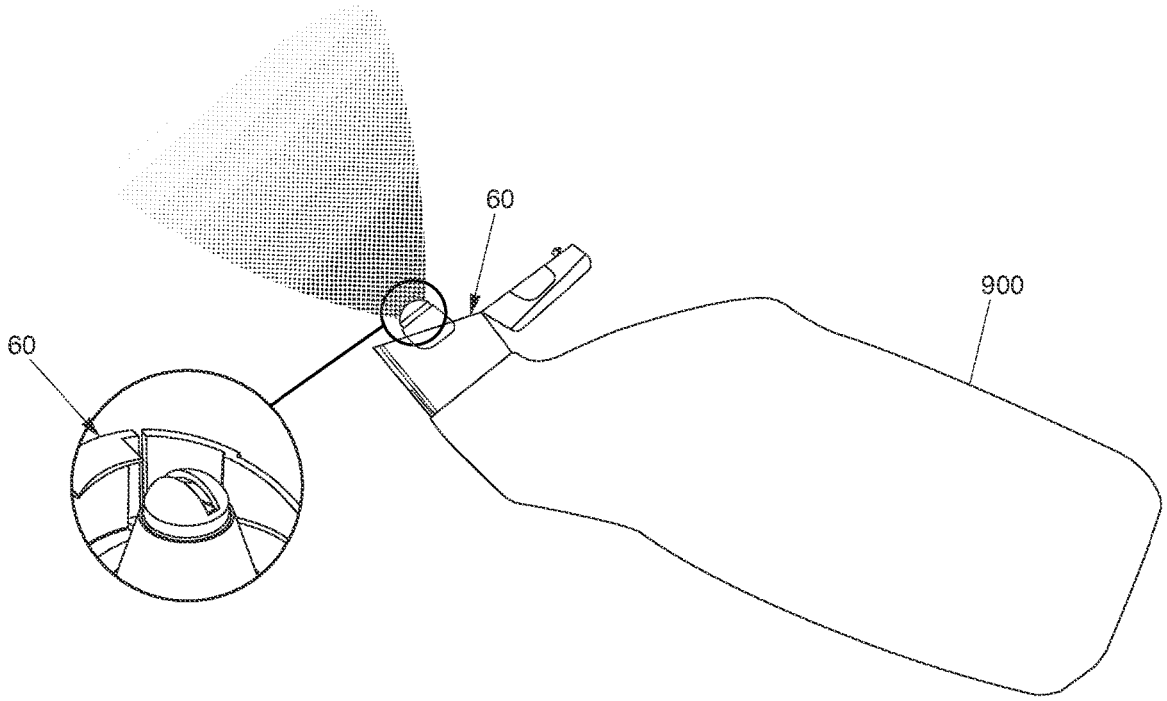
FIG. 21 is a side view of the dispensing closure of FIG. 5 attached to a squeeze-type product container with a partial perspective view of the dispensing closure of FIG. 5 in a cut-away.

Now referring to FIG. 21, in operation, the dispensing closure 60 of provides a fan-type spray or stream of liquid that fans out in a low pressure environment when the product container is squeezed. Note, any of the embodiments of the dispensing closure may be attached to the product container and this is merely an example. The low pressure environment may be less than 5 psi. In one embodiment, the dispensing closure is attached to a squeeze-type product container. When the squeeze-type product container has a force applied by a user, the liquid within the container moves through the flow conduit, collects within the tip portion to decelerate the velocity of the liquid, and discharges through the fan-type shaped exit orifice in a fan-type spray at less than 5 psi. In operation, the dispensing closure provides a stream of liquid that fans out when the product container is squeezed. Note, the purpose of the fan-type discharge is to provide a person who is cleaning, for example, a toilet bowl a wide stream of liquid to cover the desired portions of the bowl.

The flow path and velocity of the liquid through the dispensing closure during operation provides a fan-type spray in a low-pressure environment. Upon applying pressure to product container full of liquid, the liquid moves from an interior of the product container and into an interior of the dispensing closure attached to the product container. The liquid then accelerates into the flow conduit. The flow conduit has a gradually decreasing diameter which funnels the liquid into the tip portion where it temporarily collects or pools in the interior volume of the raised non-planar surface. The purpose of the raised non-planar surface is to maintain a continuous flow of the liquid discharge while it exits through the shaped exit orifice in a fan-type discharge.

Referring to FIGS. 1-8, the dispensing closure with the closure lid, or one-piece molded closure, operates in the following manner. To open the dispensing closure, the user depresses the sides of the closure body to release the closure lid whereby the closure lid is moved into an open position. Next, the user squeezes the product container to provide a discharge of liquid through the exit orifice of the flow conduit in a fan-type spray. To close the dispensing closure, the user snappingly engages the lid over the closure body.

Referring to FIGS. 9-13, the dispensing closure with the insert member, or two-piece molded closure, operates in the following manner. To open the dispensing closure, a user rotates or turns the closure body relative to the stationary insert member to remove the sealing tube away from sealing engagement with the exit orifice. Next, the user squeezes the product container to discharge liquid through the exit orifice in a fan-type spray. To close the dispensing closure, the user rotates or turns the closure body relative to the stationary insert member to return the sealing tube in sealing engagement with the exit orifice.

Figure 20:
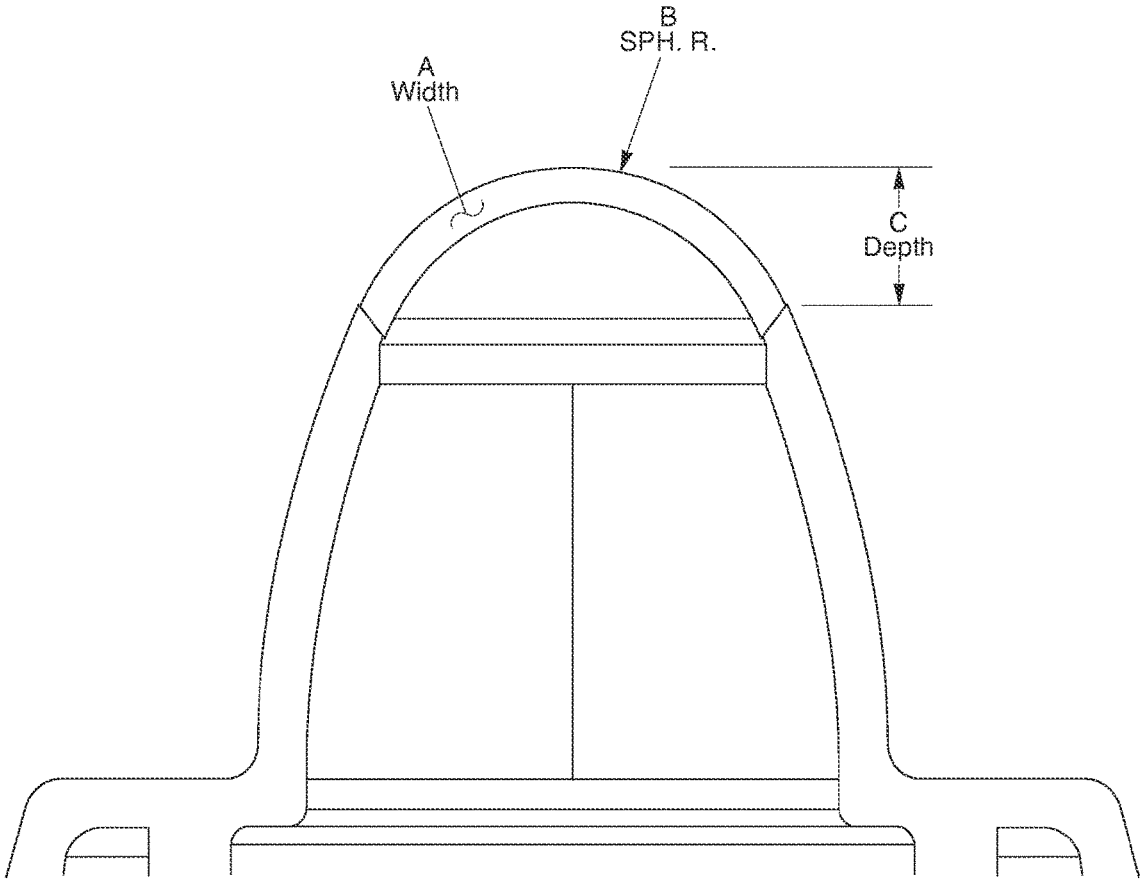
FIG. 20 is a cross-sectional view of a dispensing closure illustrating a tip portion with width (A), depth (C), and radius of exit orifice (B)

It is to be noted that the dimensions and shape of the dispensing closure, flow conduit, tip portion, and exit orifice are adjustable depending upon the viscosity of the product stored within an interior of the product container. Referring to FIG. 20, an example of a tip portion is illustrated which defines a width (A), depth (C), and radius (B) of said exit orifice which are adjustable according to the viscosity of the liquid and desired dimension of the fan-type discharge. For example, for a low viscosity liquid, it may be desirable for a flow conduit with smaller dimension to achieve a lower flow volume. Conversely, it may be desirable for a flow conduit with large dimensions for a highly viscous product to achieve a higher flow volume.

In view of the foregoing, a dispensing closure is provided related to container closures, and more particularly to squeeze-type container dispensing closures. This invention relates to a dispensing closure for dispensing liquid with varying degrees of viscosity. More specifically, it relates to a dispensing closure defining an orifice in the closure to produce a fan-type discharge or spray in a low-pressure environment.

Referring to FIGS. 22-36, a two-piece dispensing closure 100A, 100B, in another embodiment, incorporates the advantages and benefits of the above-mentioned dispensing closures 10A, 10B, 40, 60, 80 (FIGS. 1-21) defining an exit orifice 116 to produce a fan-type discharge or spay in a low-pressure environment. The two-piece dispensing closures 100A, 100B further include two pairs of opposing stopping tabs 126A, 126B and 128A, 128B which cooperate with a single pair of opposed stopping lugs 908 on a neck 910 of a container 900 to provide a child-resistant mechanism, which are further explained herein.

As shown generally in FIGS. 22-36, the present invention is generally directed to a novel dispensing closure for squeeze-type containers. Most importantly, as shown in FIG. 23, the dispensing closure 100A, 100B has an exit orifice 116 defined in a tip portion 118 of the flow conduit 120. The tip portion 118 includes a raised non-planar surface which allows for a collection of liquid before discharging liquid in a fan-type spray through the exit orifice 116 in a low pressure environment.

Figure 22:
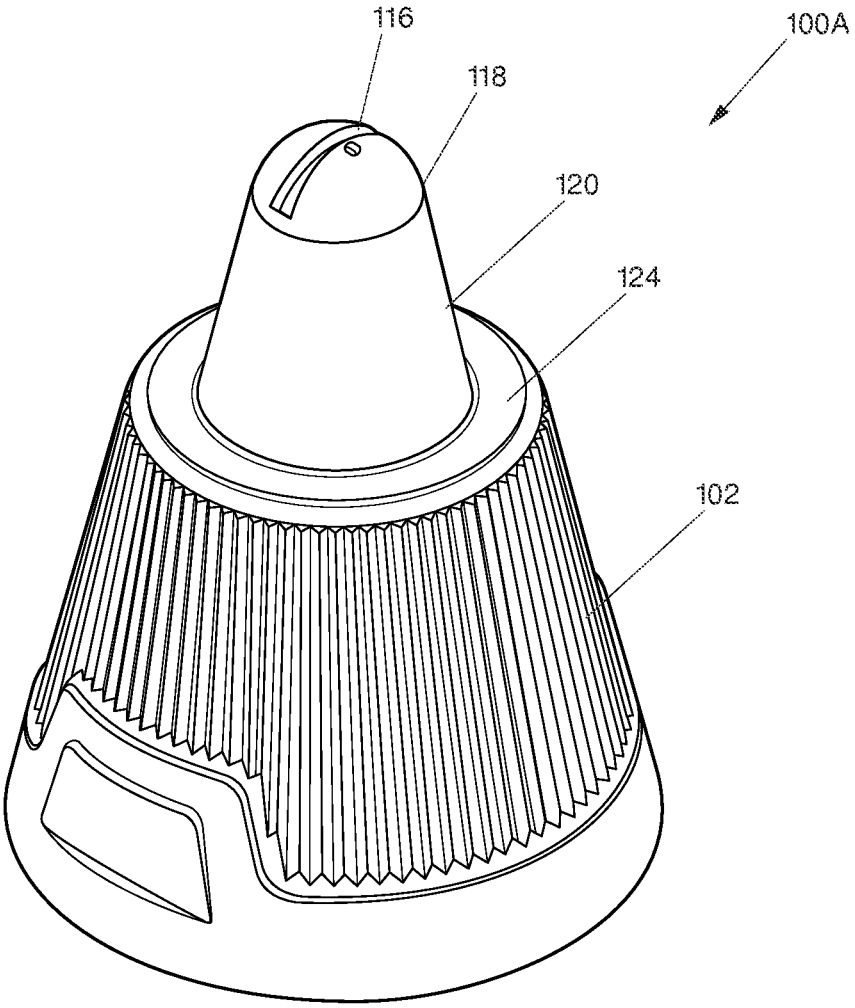
FIG. 22 is a perspective view of a two-piece dispensing closure with an insert member.
Figure 23:
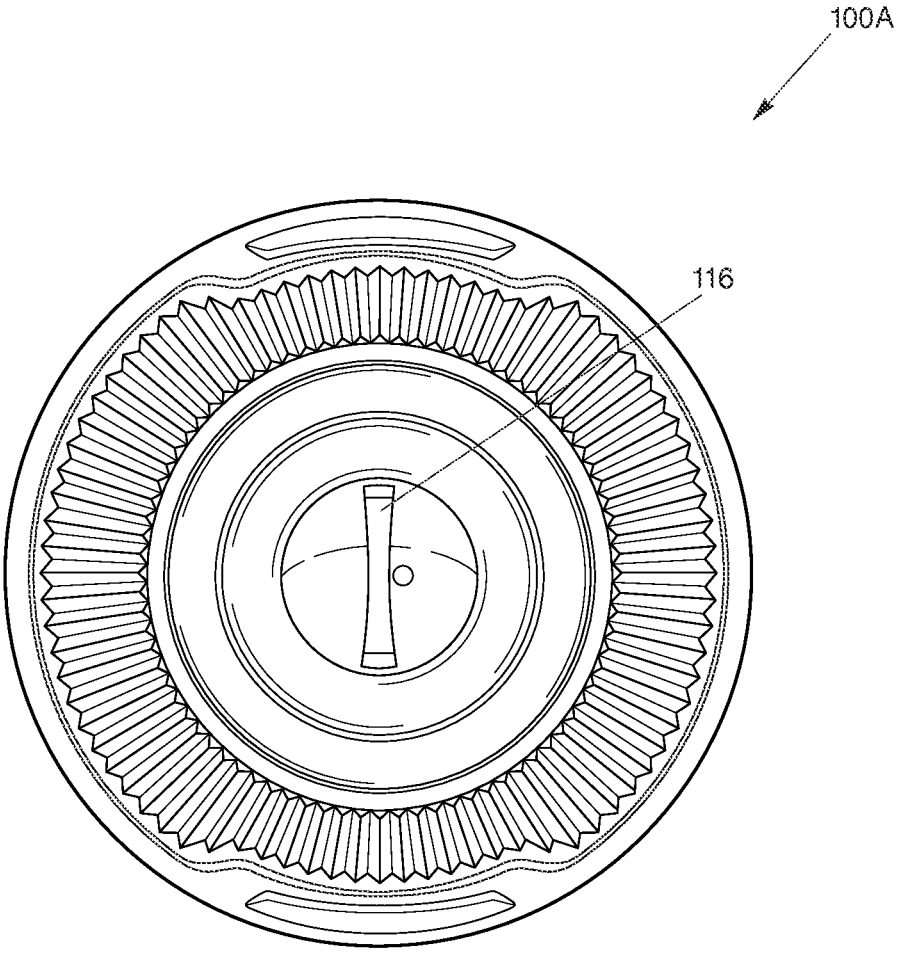
FIG. 23 is a top view of the dispensing closure of FIG. 22.
Figure 24:
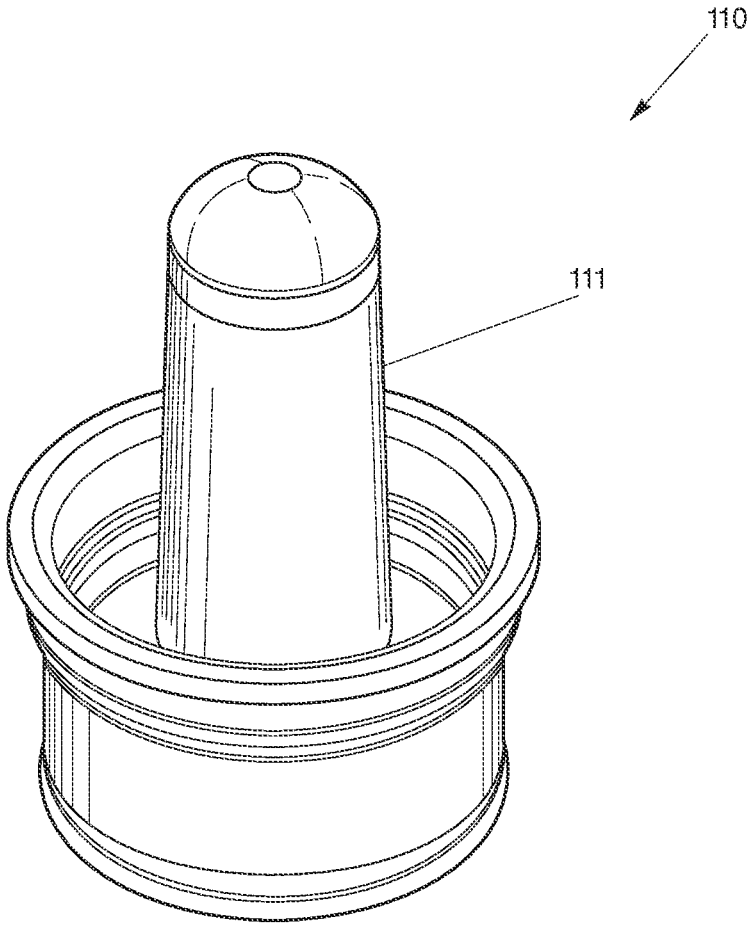
FIG. 24 is a perspective view of the insert member of FIG. 22.
Figure 25:
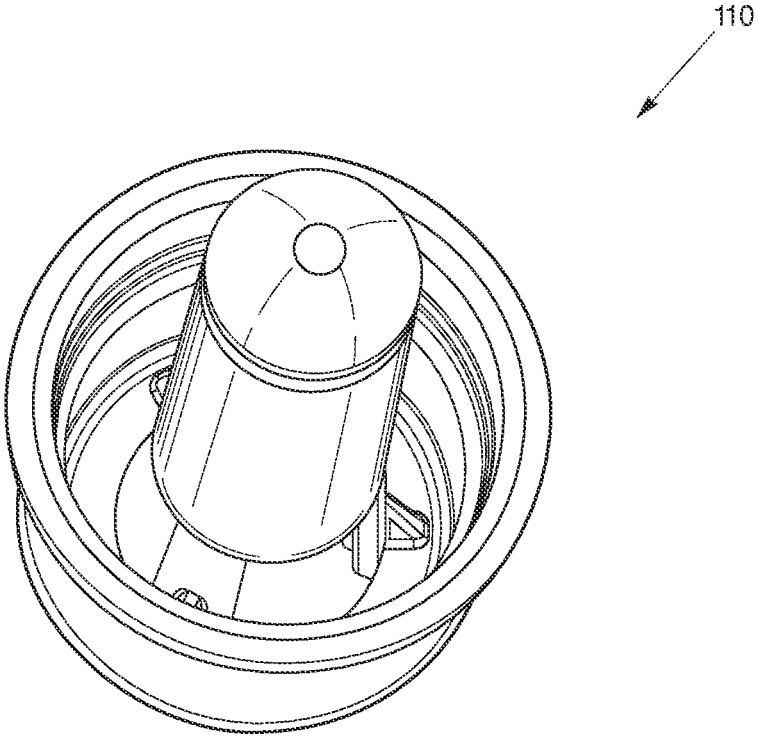
FIG. 25 is a top perspective view of the insert member of FIG. 24.
Figure 26:
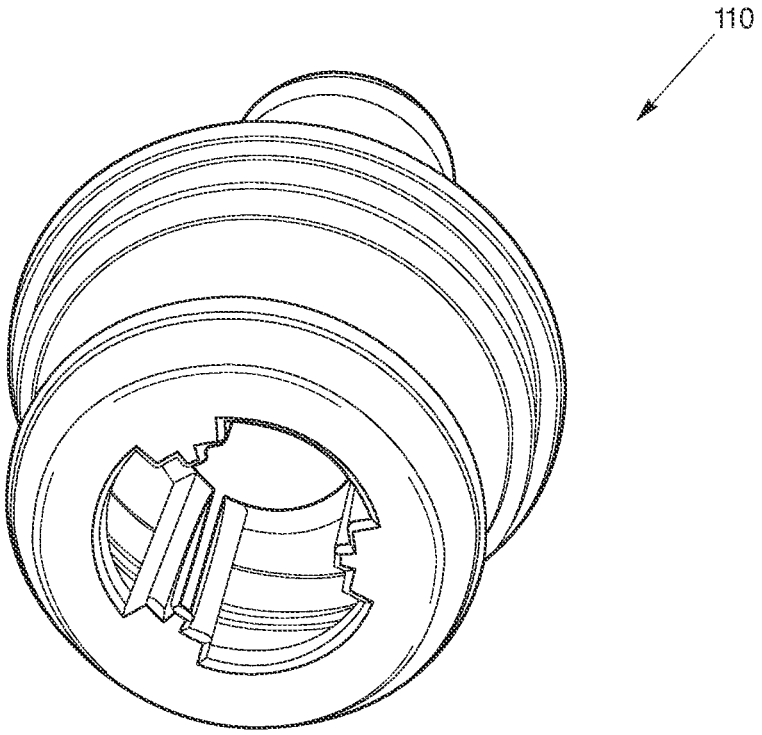
FIG. 26 is a bottom perspective view of the insert member of FIG. 24.
Figure 27:
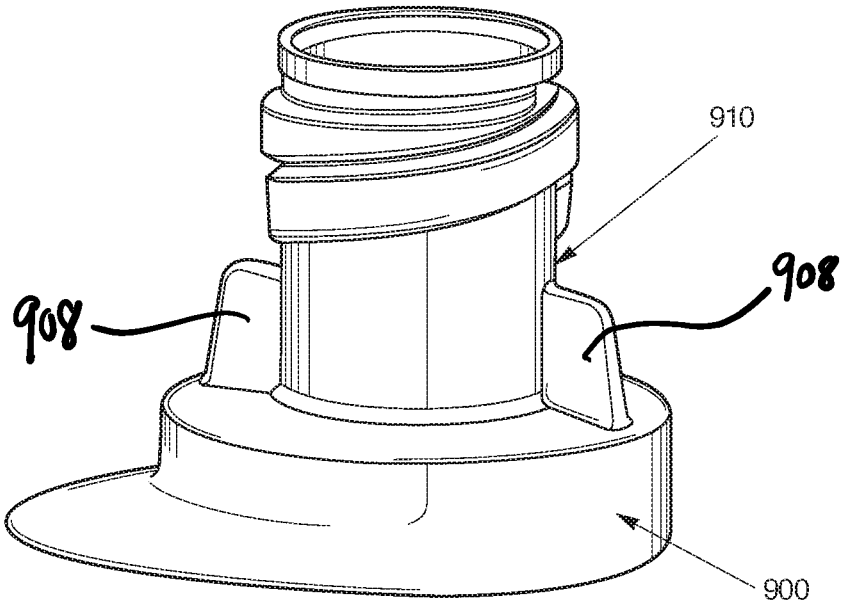
FIG. 27 is a perspective view of a neck of a bottle for engagement with the two-piece dispensing closure of FIG. 22.
Figure 28:
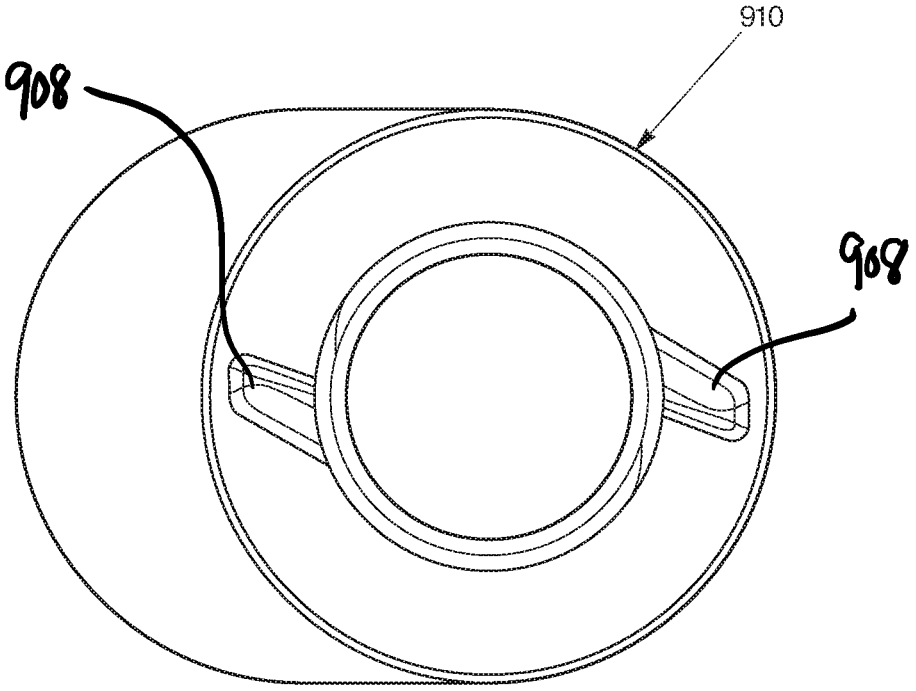
FIG. 28 is a top view of the neck of FIG. 27.
Figure 29:
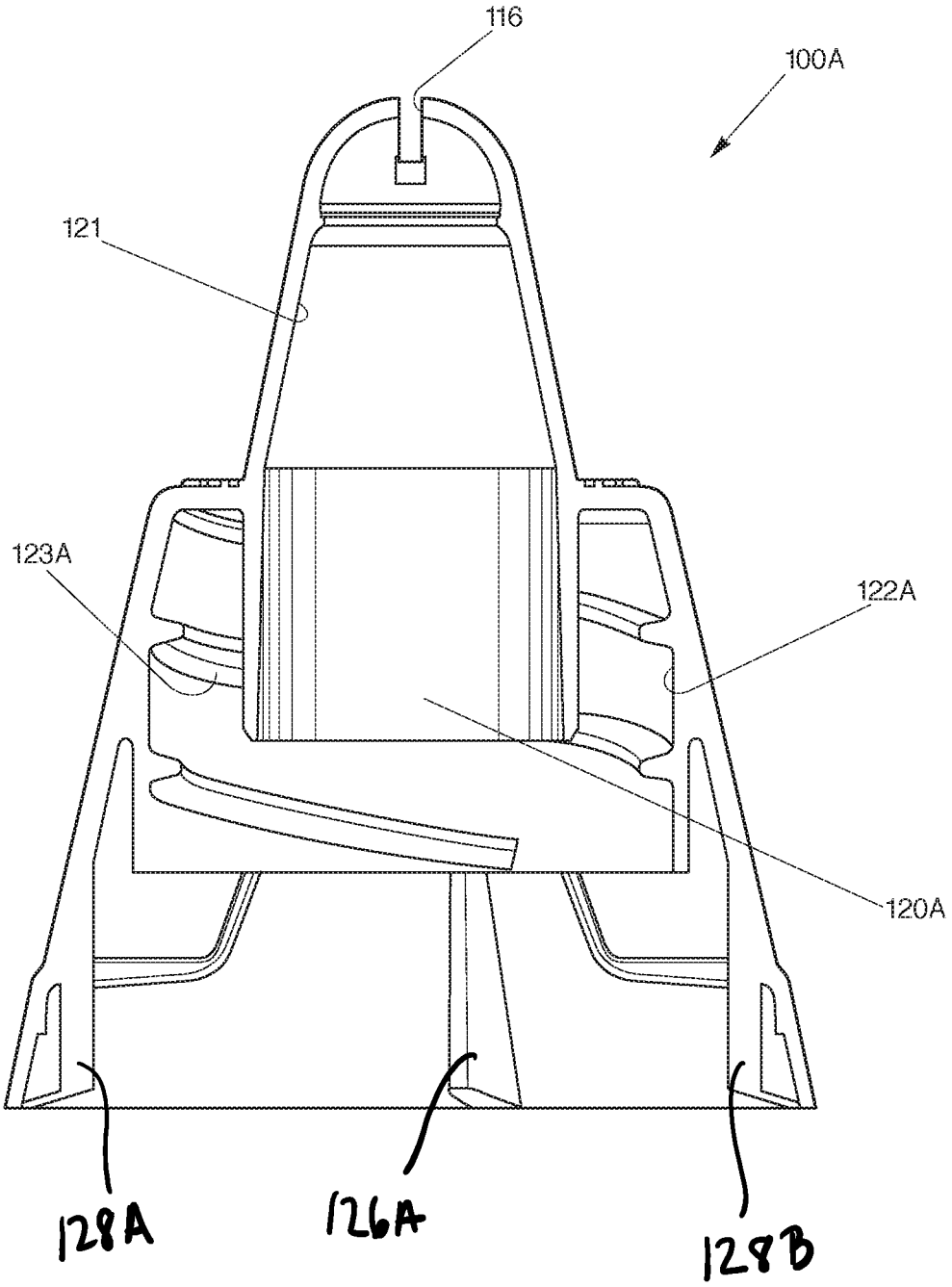
FIG. 29 is a cross-sectional view of the dispensing closure of FIG. 22.
Figure 33:
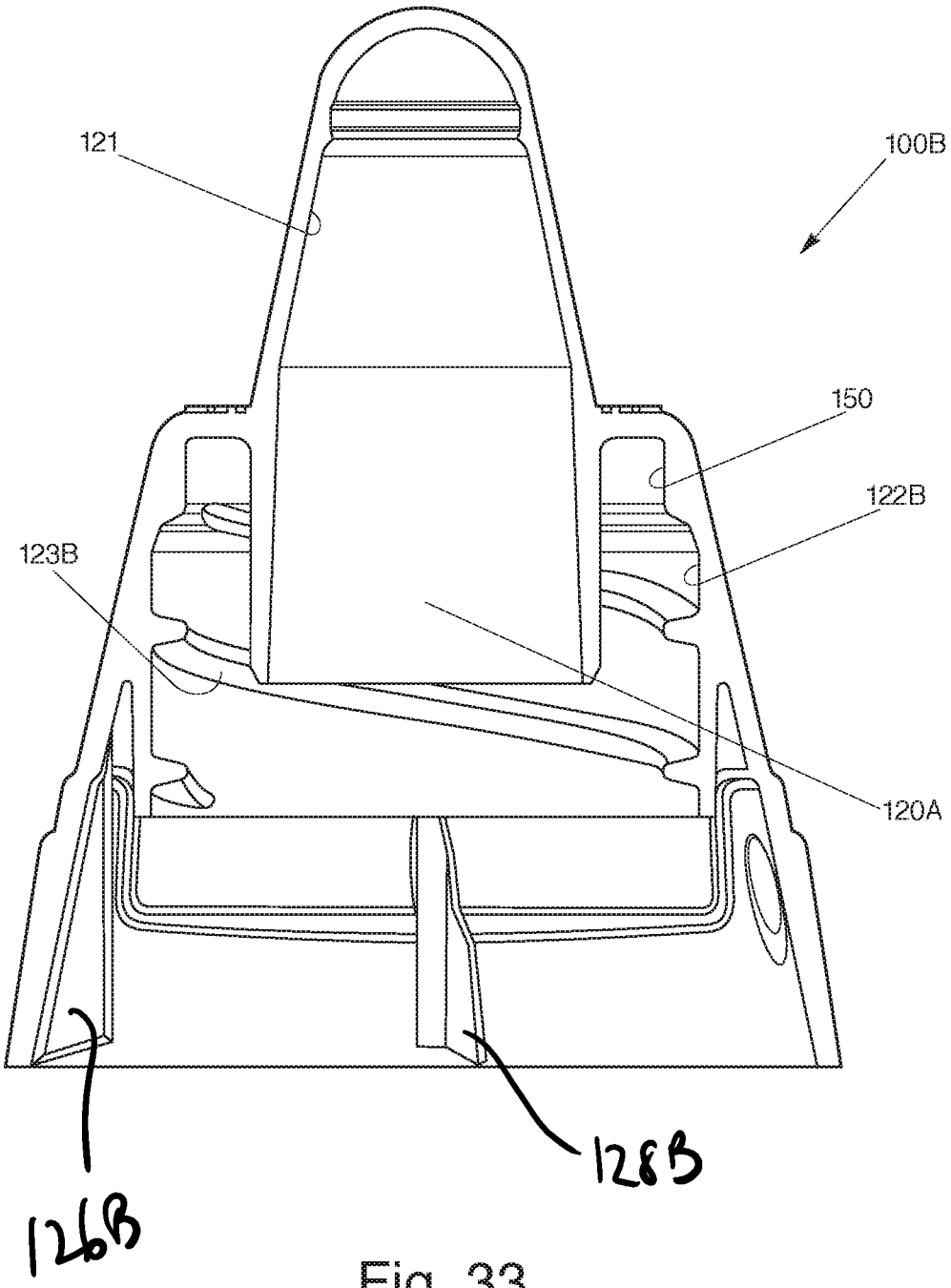
FIG. 33 is a cross-sectional view of a two-piece dispensing closure having a capture ring.

Referring to FIG. 22, the dispensing closure 100A, 100B includes a closure body 102 having an upper deck 124 and a skirt 122 depending from the upper deck 124 where the skirt 122A, 122B is configured and arranged to attach to a product container 900, such as squeeze-type product container 900 or inverted-type container (not shown). Referring to FIGS. 29 and 33, the skirt 122A, 122B includes threads 123A, 123B for threaded mounting on an open end or neck of a product container.

Referring to FIGS. 29 and 33, a flow conduit 120 extends from an interior of the closure body 102 and through the upper deck 124 to provide a flow path from an interior of the closure 100A, 100B to an exterior of the closure 100A, 1006. The flow conduit 120 has an entrance orifice 120A within the interior of the closure body 102 and an exit orifice 106 outside the exterior of the closure body 102. In one embodiment, the flow conduit 120 is raised in an elongated manner outside the exterior surface of the closure body 102. The flow conduit 120 has an inner wall 121 extending between the entrance orifice 120A and the exit orifice 116. The inner wall 121 is inclined to funnel liquid from an interior of the closure body 102 to the tip portion 118.

The flow conduit 120 includes the tip portion 118 for facilitating the production of a fan-type spray through the exit orifice 116. The tip portion 118 includes the raised non-planar surface having an interior volume to collect liquid before the liquid exits through the exit orifice 116 under low pressure. The collection of liquid within an interior volume of the raised non-planar surface provides a continuous and even flow of liquid as it exits through the exit orifice 116.

The tip portion 118 defines a shape of the exit orifice 116 which facilitates the production of the fan-type spray. Referring back to FIG. 23, the exit orifice 116 is defined along a diameter of a non-planar surface of the flow conduit 120 and the orifice 116 has a substantially rectangular shape. The rectangular exit orifice 16 has a non-uniform width to provide a non-uniform thickness and width of the fan-type spray when it exits through the exit orifice 116. Also, it should be noted that to produce a continuous fan-type spray, the exit orifice 116 may also define a uniform width, especially for the rectangular shape, and the tip portion 118 may have a relatively uniform thickness of material.

More specifically referring to FIGS. 22-36, in a two-piece dispensing closure 100 having an insert member 110 and a closure body 102, the dispensing closure 100 includes multiple sealing mechanisms similar to those disclosed in dispensing closure 80 to prevent liquid from exiting through the exit orifice 106. The dispensing closure 110 includes the insert member 110 positioned within the open end of the product container 900. The insert member 110 includes an insert base for seating within the open end of the product container 900. The insert member 110 also includes a sealing tube portion 111 extending upwardly from the insert base to occupy an interior volume of the flow conduit 120.

In a first sealing mechanism for a dispensing closure 100 having an insert member 110, the sealing tube portion 111 includes a mating surface corresponding to an interior surface of the tip portion 118. When the closure body 102 is rotated into a closed position to contact the sealing tube portion 111 with the interior surface of the tip portion 118, the liquid is prevented from discharging through the exit orifice 106.

Figure 30:
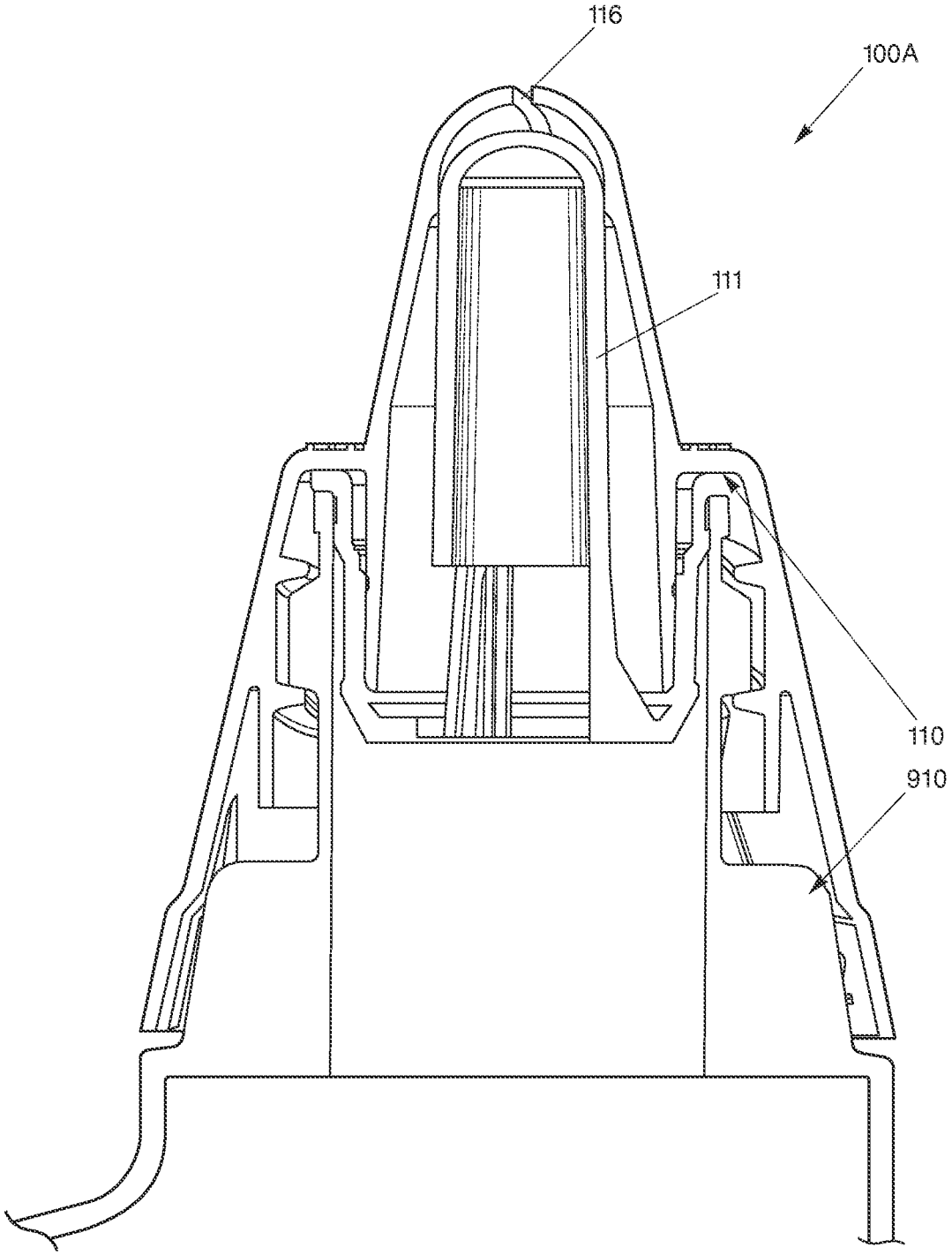
FIG. 30 is a cross-section view of the assembled dispensing closure of FIG. 22 attached to the neck of the bottle.
Figure 31:
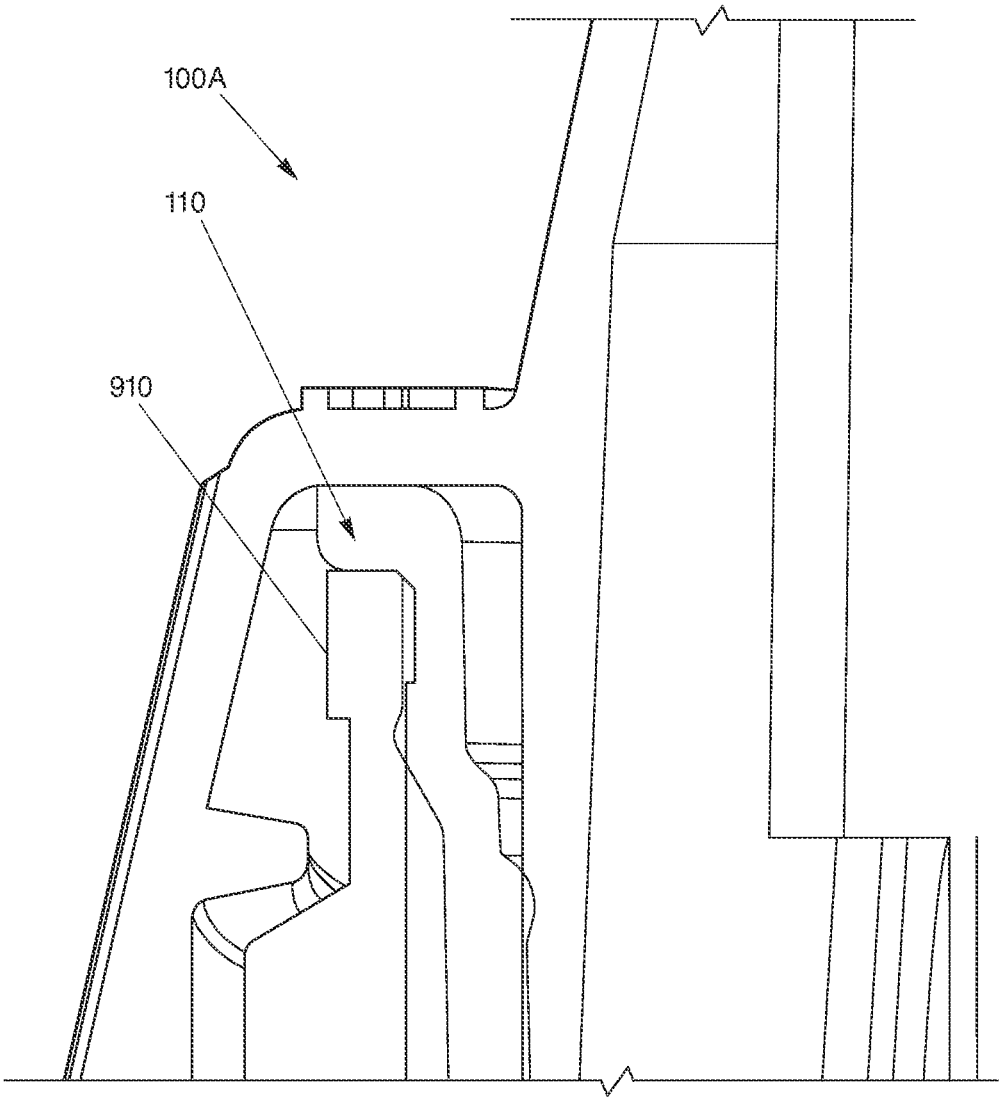
FIG. 31 is an isolated view of an upper portion of the assembled dispensing closure of FIG. 30.
Figure 32:
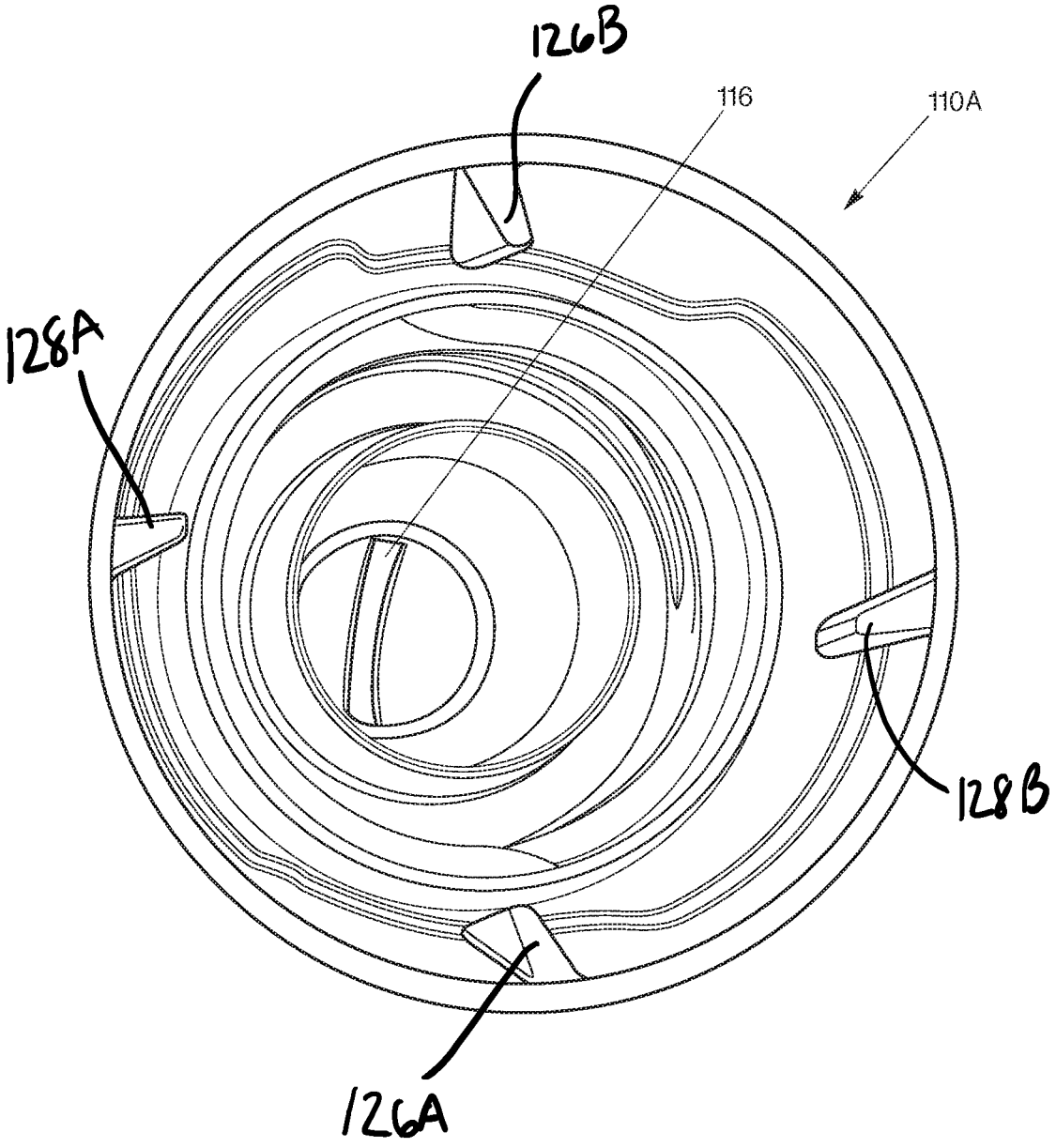
FIG. 32 is bottom view of the dispensing closure of FIG. 22.

Referring to FIG. 30, in a second sealing mechanism for a dispensing closure 110 having an insert member 110, a sealing member portion of the sealing tube portion 11 is positioned at an upper area of the insert member 110. The sealing member portion engages an interior of the flow conduit 120 when the closure body 102 is rotated into in a closed position to contact the sealing tube portion 111. The interior of the flow conduit includes a seal bead to frictionally engage the sealing member portion to prevent the flow of liquid out of the exit orifice 106. Alternatively, the sealing member portion includes the seal bead to frictionally engage the interior of the flow conduit 120. When the dispensing closure is rotated into an open position, the closure body 102 disengages from contact with the insert member 110 to allow the flow of liquid through the exit orifice 106.

The dispensing closure 100A, 100B includes a threaded container finish or neck 910, an insert member 110 received inside the opening of the container finish, with the dispensing closure 100A, 100B threadably received on the container neck 910 so that the dispensing closure is rotatable from a closed position to an open position. The dispensing closure 100A, 100B includes a flow conduit 120 with a rectangular slit-shaped orifice 116 effective for spraying a fan shaped pattern of liquid. The insert member 110 includes a sealing tube portion 111, which is positioned so that the opening in tip of the flow conduit 120 is sealed by the sealing tube portion 111 when the dispensing closure 100A, 100B is in the closed position.

Referring to FIG. 30, the dispensing closure 100A is illustrated as assembled and attached to neck of the container. When dispensing closure 100A and insert member 110 are assembled for attachment or engaging the neck of the bottle, the interference or engagement between the outer diameter of the insert member 110 and the inner diameter of the neck 910 may tend to spread out of the outer diameter of the neck of the bottle. This spreading out of the neck may over time continue to relax thereby reducing the interference or engagement which could result in an insert staying with a dispensing closure when it is opened instead of the bottle neck.

Figure 34:
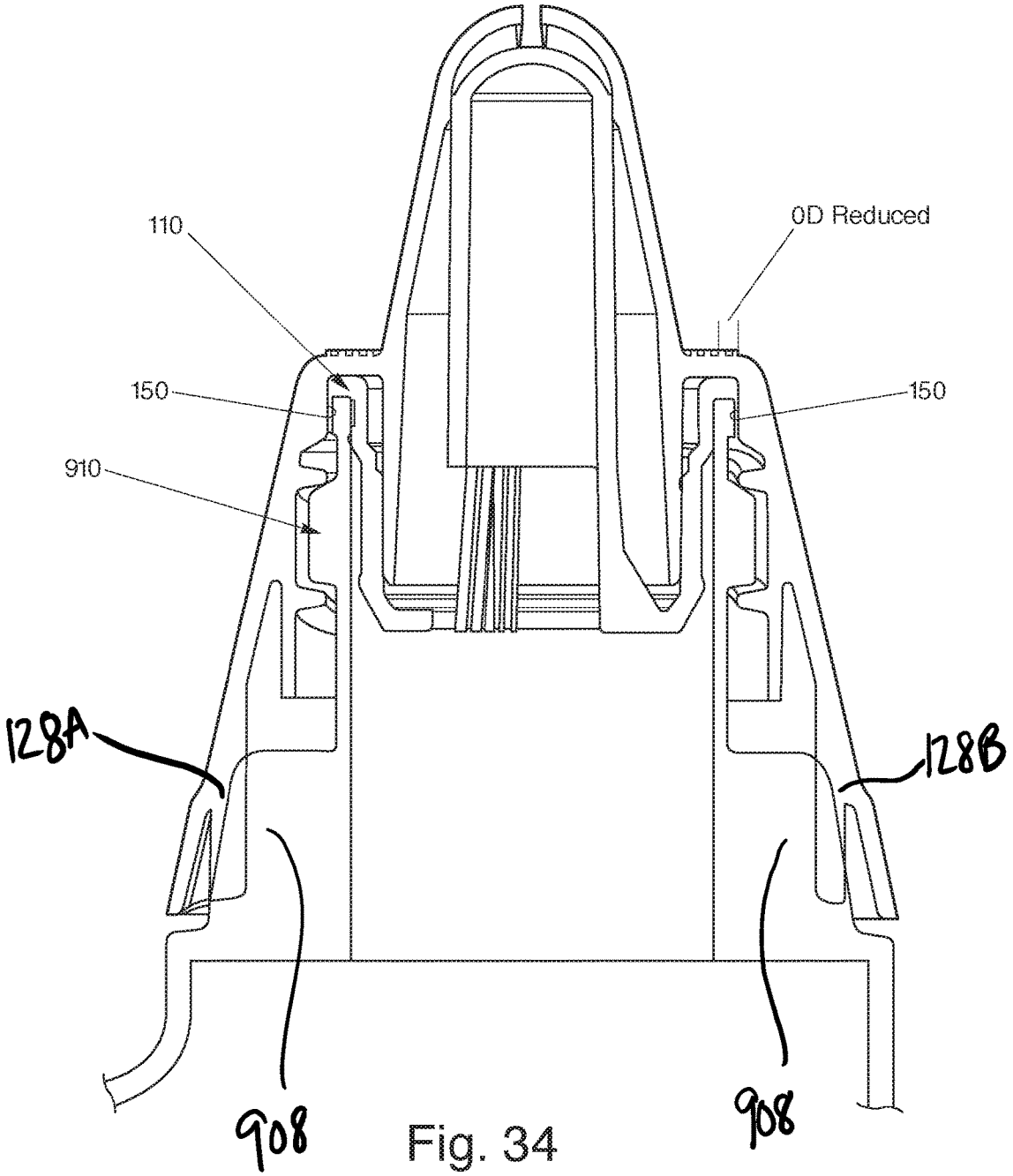
FIG. 34 is a cross-sectional view of the assembled two-piece dispensing closure of FIG. 33 attached to a neck of a bottle.
Figure 35:
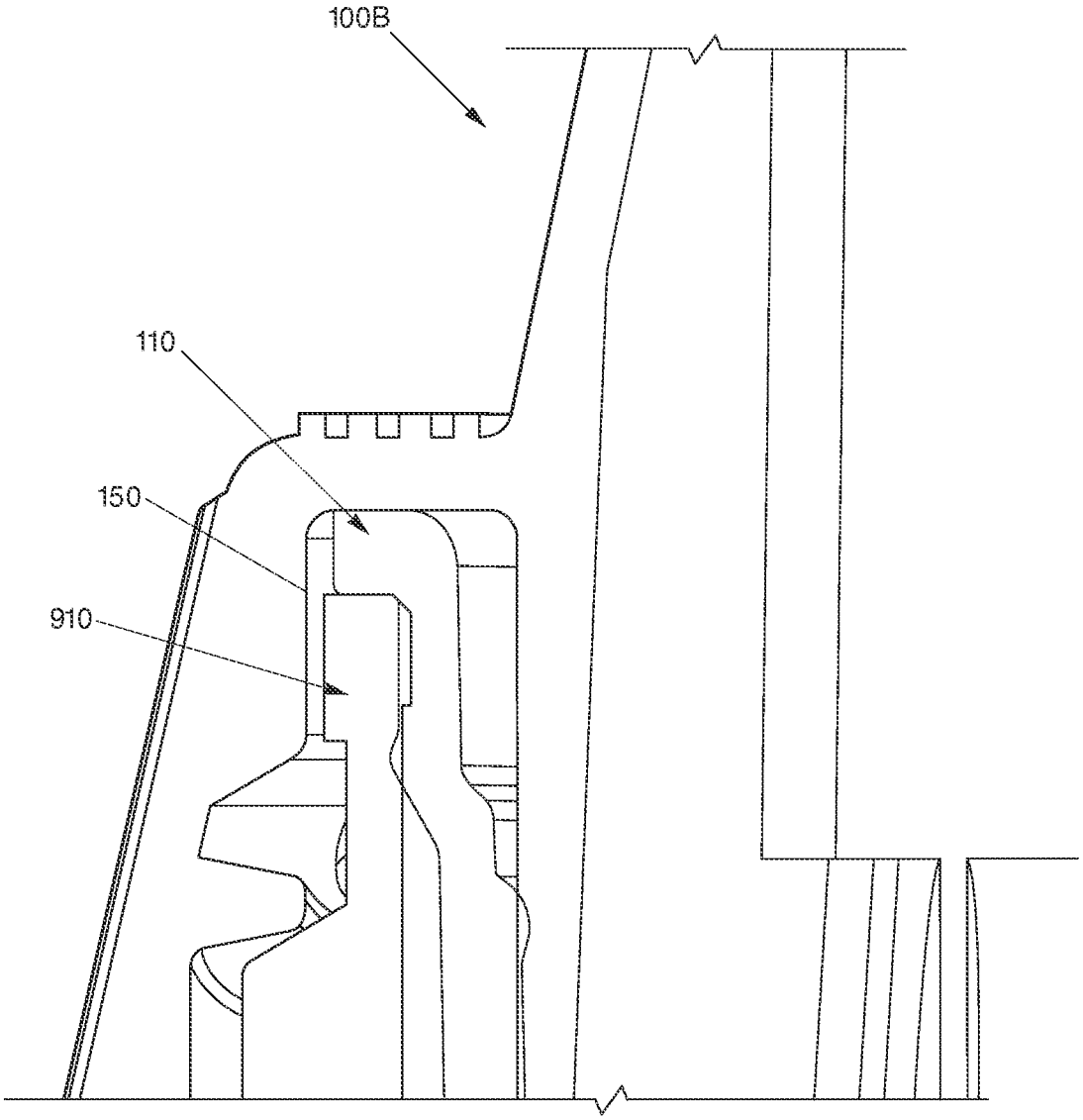
FIG. 35 is an isolated view of an upper portion of the assembled dispensing closure of FIG. 34.
Figure 36:
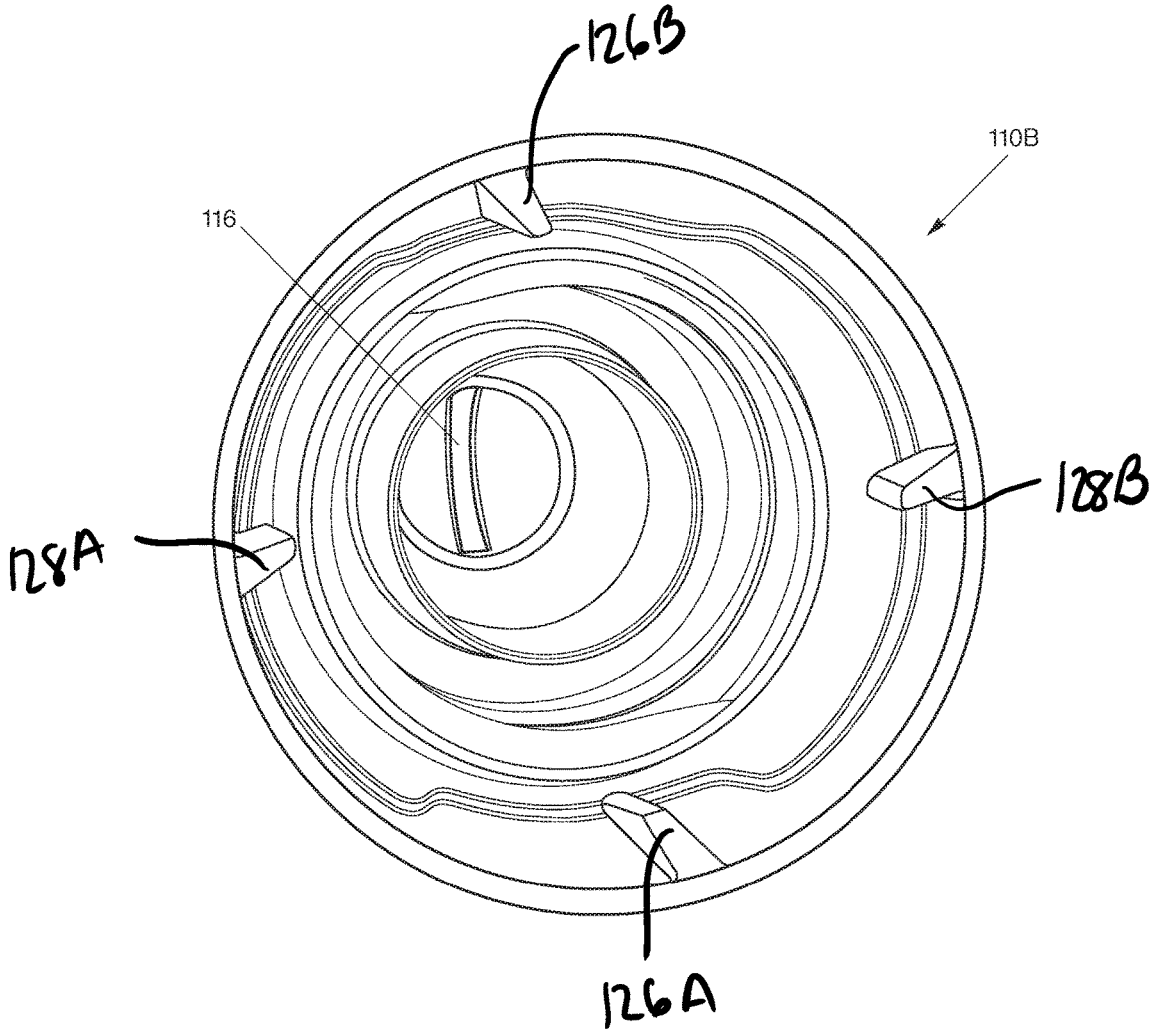
FIG. 36 is a bottom view of the dispensing closure of FIG. 33.

To reduce the spreading out of the bottle outer diameter, a thread section of an upper portion of the dispensing closure 1006, as illustrated in FIGS. 33-34, is removed thereby defining a capture ring 150. This capture ring 150 captures or holds the bottle neck and insert member in place which minimizes the initial spreading and stops any post relaxation. Upon the initial opening of the dispensing closure, the capture ring 150 maintains contact with the bottle neck and inserts member outer diameter allowing seal surfaces to break free from insert member forcing it to stay within the bottle neck. Note, the first sealing mechanism is totally disengaged before capture ring is moved up far enough to be released from the insert and bottle outer diameter. In addition, the outer diameter of the insert member may be reduced to facilitate operation of the capture ring.

The dispensing closure 100A, 100B generally includes an upper wall from which the flow conduit projects upwardly and an inner wall extending downwardly from the upper wall. The inner wall is threadably received onto the container neck. Finally, the dispensing closure includes an outer shell wall or skirt depending downwardly and outwardly from the upper wall. The threads of the container neck and inner wall of the dispensing closure are a double thread design where the cap can be moved from a fully closed position to an operative open position by rotation of approximately 90 degrees. Complete removal of the dispensing closure from the neck requires a rotation of more than 270 degrees from fully engaged to fully disengaged.

The dispensing closure 100A, 100B also includes two pairs of opposing stopping tabs 126A, 126B and 128A, 128B on the inner surface of the outer wall, which cooperate with a single pair of opposed stopping lugs 908 on the container finish. A first, opposed pair of stopping tabs 126A 126B function as child resistant latches to resist movement of the dispensing closure from the closed position to the open position. In operation, the dispensing closure must be squeezed at opposing locations (identified with thumb pads) on the dispensing closure to deform the dispensing closure and move the CR tabs 126A 126B outwardly to overcome the stop lugs 908. Once freed from the stop lugs, the dispensing closure can then rotate 90 degrees where the second set of stopping tabs 128A 128B engages with the stop lugs 908 to create a stop mechanism and prevent further rotation. This second set of stopping tabs 128A 128B prevents complete removal of the dispensing closure from the container finish.

Referring to FIGS. 22-36, the dispensing closure 110A, 110B can provide a fan-type discharge using multiple configurations of the dispensing orifice 106 other than substantially rectangular. Other shapes of the exit orifice 106 that may be used are, for example, a bowtie shape (FIG. 14), curved rectangular shape (FIG. 15), dumbbell shape (FIG. 16), half bowtie shape (FIG. 17), keyhole shape (FIG. 18), oval shape (FIG. 19), "J" shape, "T" shape, inverted "T" shape, inverted "J" shape, and other non-circular shapes.

It would be appreciated by those skilled in the art that various changes and modifications can be made to the illustrated embodiments without departing from the spirit of the present invention. All such modifications and changes are intended to be within the scope of the present invention.

What is claimed is:

1. A dispensing closure for discharging a sprayable liquid from a squeeze container, comprising:

an insert member including a base configured and arranged to be received in seated engagement with a neck of a squeeze container, a sealing tube extending upwardly from said base, said sealing tube having a sealing tip portion at an upper end thereof; and a closure body including an upper deck, a skirt depending downwardly from said upper deck, said skirt being configured and arranged to attach to said neck of said container, a flow conduit extending upwardly from said upper deck to provide a flow path from an interior of said closure to an exterior of said closure, said flow conduit having a dispensing tip portion, said flow conduit including an entrance orifice and an exit orifice at said dispensing tip portion, said flow conduit having an inner wall extending between said entrance orifice and said exit orifice, said closure body being movable relative to said base between a closed position wherein said sealing tip portion of said sealing tube matingly engages said inner wall of said flow conduit in an area of said dispensing tip portion and prevents a flow of liquid from exiting said exit orifice, and an open position wherein said inner wall of said flow conduit in the area of said dispensing tip is spaced from said sealing tip portion of said sealing tube and allows a flow of liquid to exit said exit orifice, said exit orifice having a non-circular shape producing a non-circular fan spray of liquid in a low-pressure environment of less than 5 psi, wherein said squeeze container is inverted and squeezed producing the non-circular fan spray of liquid, and said closure body further including a stop mechanism configured to stop movement of said closure body in said open position.

2. The dispensing closure of claim 1 wherein said closure body includes a child resistant locking mechanism.

3. The dispensing closure of claim 2, wherein said dispensing tip portion has a non-planar surface having an interior volume to collect liquid before liquid exits through said exit orifice.

4. The dispensing closure of claim 3, wherein said non-planar surface is a semi-spherical outer surface.

5. The dispensing closure of claim 4, wherein said exit orifice has a shape selected from a group consisting of: rectangular, bowtie, half bowtie, oval, keyhole, dumbbell, and curved rectangular.

6. The dispensing closure of claim 3, wherein said exit orifice has a shape selected from a group consisting of: rectangular, bowtie, half bowtie, oval, keyhole, dumbbell, and curved rectangular.

7. The dispensing closure of claim 1, wherein said dispensing tip portion has a non-planar surface having an interior volume to collect liquid before liquid exits through said exit orifice.

8. The dispensing closure of claim 7, wherein said non-planar surface is a semi-spherical outer surface.

9. The dispensing closure of claim 8, wherein said exit orifice has a shape selected from a group consisting of: rectangular, bowtie, half bowtie, oval, keyhole, dumbbell, and curved rectangular.

10. The dispensing closure of claim 7, wherein said exit orifice has a shape selected from a group consisting of: rectangular, bowtie, half bowtie, oval, keyhole, dumbbell, and curved rectangular.

* * * * *